US012037867B2

(12) United States Patent
Fripp et al.

(10) Patent No.: US 12,037,867 B2
(45) Date of Patent: Jul. 16, 2024

(54) DOWNHOLE ZONAL ISOLATION ASSEMBLY

(71) Applicant: Halliburton Energy Services, Inc., Houston, TX (US)

(72) Inventors: Michael Linley Fripp, Carrollton, TX (US); Richard Decena Ornelaz, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/792,360

(22) PCT Filed: Feb. 28, 2020

(86) PCT No.: PCT/US2020/020379
§ 371 (c)(1),
(2) Date: Jul. 12, 2022

(87) PCT Pub. No.: WO2021/173155
PCT Pub. Date: Sep. 2, 2021

(65) Prior Publication Data

US 2023/0050733 A1 Feb. 16, 2023

(51) Int. Cl.

| | |
|---|---|
| ***E21B 33/124*** | (2006.01) |
| ***E21B 34/06*** | (2006.01) |
| ***E21B 34/14*** | (2006.01) |
| ***E21B 43/14*** | (2006.01) |
| ***E21B 43/26*** | (2006.01) |

(52) U.S. Cl.
CPC ..... *E21B 33/124* (2013.01); *E21B 34/066* (2013.01); *E21B 34/142* (2020.05); *E21B 43/14* (2013.01); *E21B 43/26* (2013.01); *E21B 2200/05* (2020.05); *E21B 2200/06* (2020.05)

(58) Field of Classification Search
CPC .... E21B 33/124; E21B 34/066; E21B 34/142; E21B 43/14; E21B 43/26; E21B 2200/05; E21B 2200/06; E21B 34/14; E21B 43/12
See application file for complete search history.

(56) References Cited

U.S. PATENT DOCUMENTS 5,839,508 A 11/1998 Tubel et al.
6,125,938 A 10/2000 Garcia-Soule et al.
(Continued)

FOREIGN PATENT DOCUMENTS

WO WO-9705362 A1 * 2/1997 ..... E21B 34/066
WO 2019151993 A1 8/2019

*Primary Examiner* — James G Sayre
(74) *Attorney, Agent, or Firm* — Scott Richardson; Parker Justiss, P.C.

(57) ABSTRACT

Provided is a downhole zonal isolation assembly. The downhole zonal isolation assembly, in accordance with one aspect, includes a rotating fracturing valve positionable within wellbore casing proximate a fracturing zone of interest. The downhole zonal isolation assembly, according to this aspect, further includes a rotating fracturing valve actuator coupled to the rotating fracturing valve, and rotating fracturing valve electronics coupled to the rotating fracturing valve actuator, the rotating fracturing valve electronics operable to activate the rotating fracturing valve actuator to move the rotating fracturing valve from a first wellbore casing open position to a second wellbore casing closed position.

23 Claims, 18 Drawing Sheets

(56) References Cited

U.S. PATENT DOCUMENTS 6,907,936 B2 * 6/2005 Fehr ..... E21B 33/124 166/185
7,287,596 B2 10/2007 Frazier et al.
7,802,627 B2 9/2010 Hofman et al.
8,118,098 B2 2/2012 Hromas et al.
8,162,050 B2 4/2012 Roddy et al.
8,727,010 B2 5/2014 Turner et al.
9,638,003 B2 5/2017 George et al.
2002/0121373 A1 9/2002 Patel
2005/0230118 A1 * 10/2005 Noske ..... E21B 41/0021 166/332.8
2007/0295515 A1 12/2007 Veneruso et al.
2009/0065194 A1 3/2009 Frazier
2010/0314106 A1 12/2010 Tubel
2011/0120726 A1 5/2011 Murray et al.
2012/0018172 A1 1/2012 Javed
2012/0037380 A1 * 2/2012 Arizmendi, Jr. ..... E21B 34/06 166/332.8
2012/0061095 A1 3/2012 Capderou
2012/0067567 A1 3/2012 Rytlewski et al.
2012/0085548 A1 4/2012 Fleckenstein et al.
2012/0118579 A1 5/2012 Murray et al.
2013/0153242 A1 6/2013 Flight et al.
2014/0041876 A1 * 2/2014 Fleckenstein ..... E21B 43/14 166/329
2014/0083689 A1 * 3/2014 Streich ..... E21B 34/102 166/250.15
2014/0102708 A1 * 4/2014 Purkis ..... E21B 43/26 166/308.1
2015/0122493 A1 5/2015 Wood et al.
2015/0322748 A1 * 11/2015 Purkis ..... E21B 47/13 307/143
2016/0281464 A1 * 9/2016 Hulsewe ..... E21B 43/26
2019/0145220 A1 5/2019 Patel et al.
2019/0234179 A1 8/2019 Walton et al.
2020/0248531 A1 8/2020 Walton et al.
2021/0301623 A1 9/2021 Fuglestad
2022/0042396 A1 * 2/2022 Tiwari ..... E21B 34/08
2022/0065080 A1 3/2022 Alkhalidi

* cited by examiner

DOWNHOLE ZONAL ISOLATION ASSEMBLY

CROSS-REFERENCE TO RELATED APPLICATION

This application is the National Stage of, and therefore claims the benefit of, International Application No. PCT/US2020/020379 filed on Feb. 28, 2020, entitled "DOWNHOLE ZONAL ISOLATION ASSEMBLY," which was published in English under International Publication Number WO 2021/173155 on Sep. 2, 2021. The above application is commonly assigned with this National Stage application and is incorporated herein by reference in its entirety.

BACKGROUND

The process of induced hydraulic fracturing involves injecting a fracturing fluid at a high pressure into a fracturing zone of interest. Small fractures are formed, allowing fluids, such as gas and petroleum to migrate into the wellbore for producing to the surface. Often the fracturing fluid is mixed with proppants (e.g., sand) and chemicals in water so that once the pressure is removed, the sand or other particles hold the fractures open. Other fracturing fluids use concentrated acid to dissolve parts of the formation so that once the pressure is removed, dissolved tunnels are formed in the formation. Hydraulic fracturing is a type of well stimulation, whereby the fluid removal is enhanced, and well productivity is increased.

Multi-stage hydraulic fracturing is an advancement to produce fluids along a single wellbore or fracturing string. Multiple stages allow the fracturing fluid to be targeted at individual zones. Zones are typically fractured in a sequence. Previously fractured zones are isolated from the next zones to be fracture.

In a multi-stage fracturing process, previously fractured zones must be isolated from the zones that are going to be stimulated. Traditionally, isolation is performed with a ball that lands either on a ball seat or on a fracturing plug. The ball seats or fracturing plugs are positioned within zones of interest in the wellbore. Hydraulic fracturing can be performed in stages by selectively activating sleeves by the ball landing on a ball seat which also isolates the particular zones of interest from the previously fractured zones. Each target zone can be hydraulically fractured, stage by stage (e.g., toe to heal).

What are needed in the art are improved apparatus, systems, and methods for fracturing multi-stage zones.

BRIEF DESCRIPTION

Reference is now made to the following descriptions taken in conjunction with the accompanying drawings, in which:

FIG. 1 schematically illustrates a well system, including a downhole fracturing tool assembly, and a downhole zonal isolation assembly, each of which are designed, manufactured and operated according to the present disclosure;

FIG. 2A schematically illustrates an alternative well system designed, manufactured, and operated according to one embodiment of the disclosure;

FIG. 2B schematically illustrates an alternative well system designed, manufactured, and operated according to one embodiment of the disclosure;

DETAILED DESCRIPTION

Figure 1:
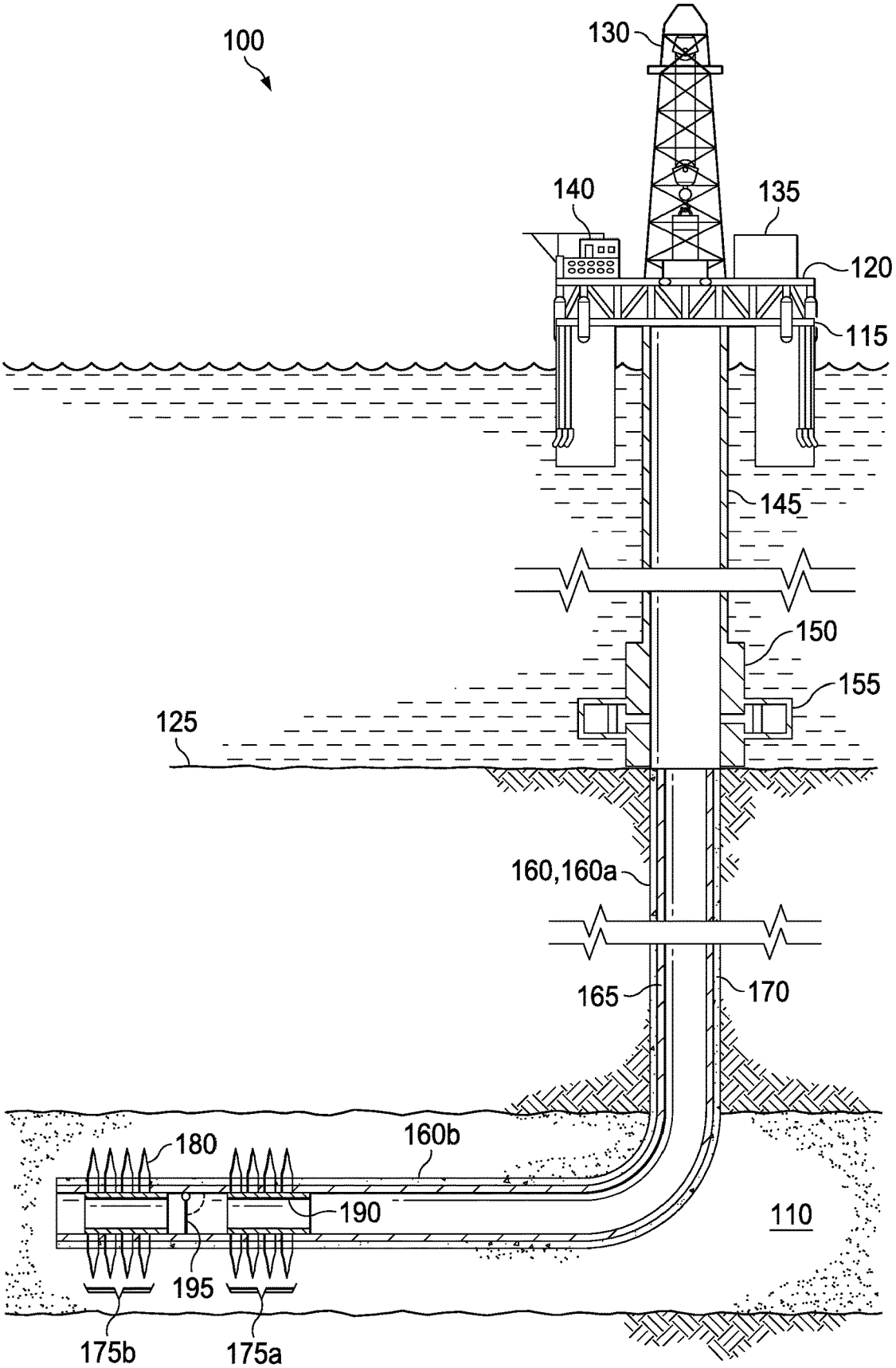

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally toward the surface of the ground; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. In some instances, a part near the end of the well can be horizontal or even slightly directed upwards. In such instances, the terms "up," "upper," "upward," "uphole," "upstream," or other like terms shall be used to represent the toward the surface end of a well. Unless otherwise specified, use of the term "subterranean formation" shall be construed as encompassing both areas below exposed earth and areas below earth covered by water such as ocean or fresh water.

The term "proximate," as used herein with regard to the placement of two features relative to one another, means that the two features are located within about 150 meters (e.g., about 500 feet) of one another. The term "substantially proximate," as used herein with regard to the placement of two features relative to one another, means that the two features are located within about 30 meters (e.g., about 100 feet) of one another. The term "ideally proximate," as used herein with regard to the placement of two features relative to one another, means that the two features are located within about 10 meters (e.g., about 30 feet) of one another.

Referring initially to FIG. 1, schematically illustrated is a well system 100, including a downhole fracturing tool assembly 190, and a downhole zonal isolation assembly 195, each of which are designed, manufactured and operated according to the present disclosure, and positioned at a desired location in a subterranean formation 110. The well system 100 of FIG. 1, without limitation, includes a semi-submersible platform 115 having a deck 120 positioned over the submerged oil and gas formation 110, which in this embodiment is located below sea floor 125. The platform 115, in the illustrated embodiment, may include a hoisting apparatus/derrick 130 for raising and lowering work string, as well as a fracturing pump 135 for conducting a fracturing process of the subterranean formation 110 according to the disclosure. The well system 100 illustrated in FIG. 1 additionally includes a control system 140 located on the deck 120. The control system 140, in one embodiment, may be used to control the fracturing pump 135, as well as may be communicatively, e.g., electrically, electromagnetically or fluidly, coupled to the downhole fracturing tool assembly 190 and/or downhole zonal isolation assembly 195, among other uses.

A subsea conduit 145 extends from the platform 115 to a wellhead installation 150, which may include one or more subsea blow-out preventers 155. A wellbore 160 extends through the various earth strata including formation 110. In the embodiment of FIG. 1, wellbore casing 165 is cemented within wellbore 160 by cement 170. In the illustrated embodiment, wellbore 160 has an initial, generally vertical portion 160*a* and a lower, generally deviated portion 160*b*, which is illustrated as being horizontal. It should be noted by those skilled in the art, however, that the downhole fracturing tool assembly 190 and downhole zonal isolation assembly 195 of the present disclosure are equally well-suited for use in other well configurations including, but not limited to, inclined wells, wells with restrictions, non-deviated wells and the like. Moreover, while the wellbore 160 is positioned below the sea floor 125 in the illustrated embodiment of FIG. 1, those skilled in the art understand that the principles of the present disclosure are equally as applicable to other subterranean formations, including those encompassing both areas below exposed earth and areas below earth covered by water such as ocean or fresh water.

In accordance with one embodiment of the disclosure, the downhole fracturing tool assembly 190 includes a fracturing port cover coupleable to an interior of the wellbore casing 165. The wellbore casing 165, in the example embodiment, would have one or more fracturing ports therein. The downhole fracturing tool assembly 190, in accordance with this embodiment, additionally includes a fracturing port cover actuator coupled to the fracturing port cover, the fracturing port cover actuator operable to move the fracturing port cover between a first position sealing the one or more fracturing ports from an interior of the wellbore casing 165 and a second position exposing the one or more fracturing ports to the interior of the wellbore casing 165. The downhole fracturing tool assembly 190, in accordance with this embodiment, further includes fracturing port cover electronics coupled to the fracturing port cover actuator proximate the fracturing port cover, the fracturing port cover electronics operable (e.g., programmed in one embodiment) to activate the fracturing port cover actuator.

In accordance with one embodiment of the disclosure, the downhole zonal isolation assembly 195 includes a rotating fracturing valve positionable within the wellbore casing 165 proximate one or more fracturing zones of interest 175*a*, 175*b*. The downhole zonal isolation assembly 195, in accordance with this embodiment, additionally includes a rotating fracturing valve actuator coupled to the rotating fracturing valve, and rotating fracturing valve electronics coupled to the rotating fracturing valve actuator, the rotating fracturing valve electronics operable (e.g., programmed in one embodiment) to activate the rotating fracturing valve actuator to move the rotating fracturing valve from a first wellbore casing 165 open position to a second wellbore casing 165 closed position.

When it is desired to fracture a particular subterranean zone of interest, such as fracturing zones of interest 175*a*, 175*b*, the downhole fracturing tool assembly 190 and downhole zonal isolation assembly 195 may be appropriately actuated, for example opening and closing certain ones of the fracturing port covers, as well as opening and closing certain ones of the rotating fracturing valves. Thereafter, pressure within the wellbore 160 may be increased using the fracturing pump 135 and one or more different types of fracturing fluid and/or proppants, thereby forming fractures 180.

Figure 2A:
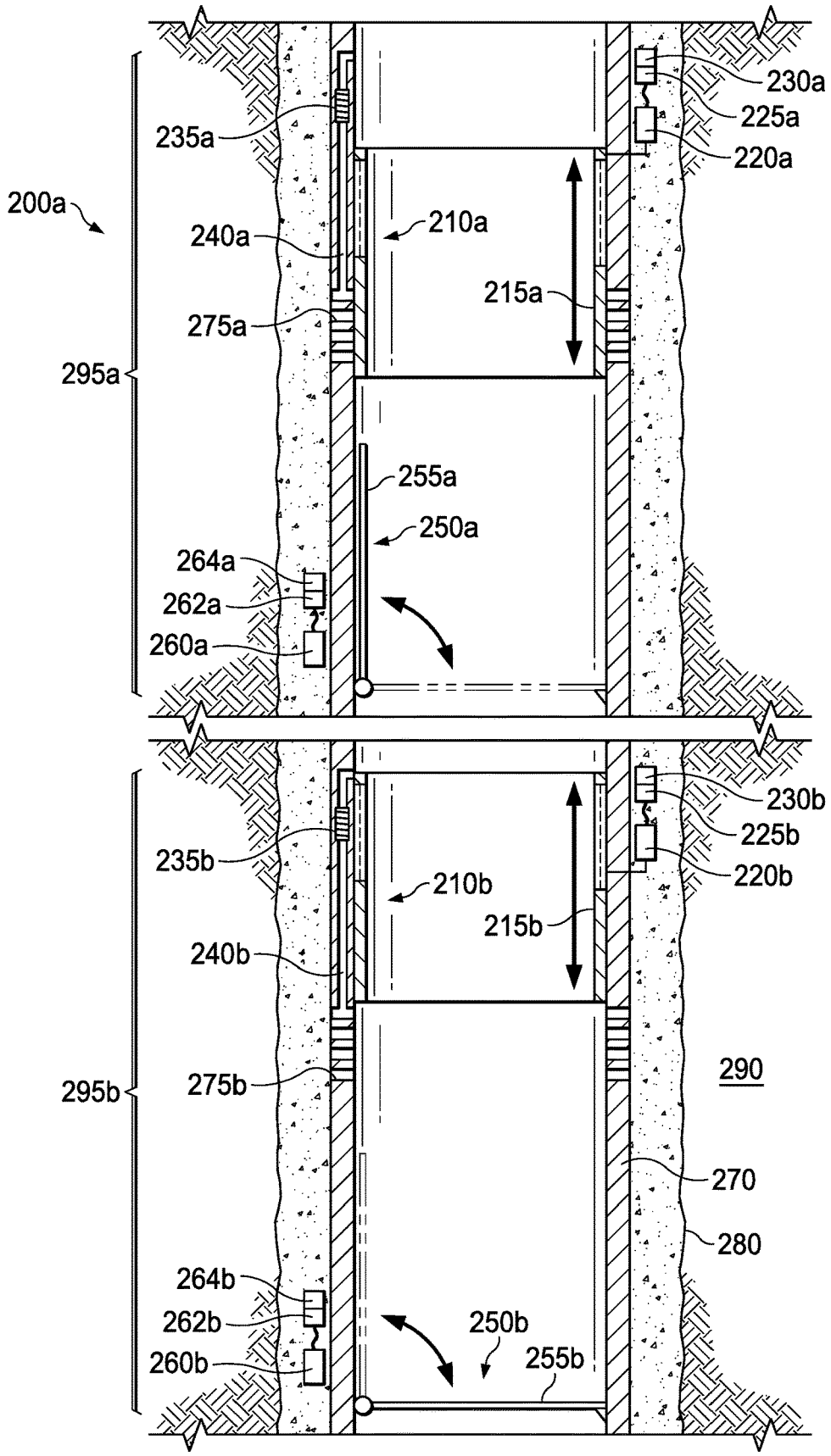

Referring now to FIG. 2A, schematically illustrated is a well system 200*a* designed, manufactured, and operated according to one embodiment of the disclosure. The well system 200*a*, in the illustrated embodiment, includes first and second downhole fracturing tool assemblies 210*a*, 210*b*, and first and second downhole zonal isolation assemblies 250*a*, 250*b*, each of which are designed, manufactured, and operated according to one embodiment of the disclosure. While the well system 200*a* illustrated in FIG. 2A includes first and second downhole fracturing tool assemblies 210*a*, 210*b*, and first and second downhole zonal isolation assemblies 250*a*, 250*b*, other embodiments may exist wherein a single downhole fracturing tool assembly and/or single downhole zonal isolation assembly is used, or alternatively wherein three or more downhole fracturing assemblies and/or three or more downhole zonal isolation assemblies are used. It should further be noted that while the downhole fracturing tool assembly and downhole zonal isolation assembly may be used together, as illustrated in FIG. 2A, other embodiments may exist wherein the downhole fracturing tool assembly is used without the downhole zonal isolation assembly, or alternatively the downhole zonal isolation assembly is used without the downhole fracturing tool assembly.

In the embodiment illustrated in FIG. 2A, the first and second downhole fracturing tool assemblies 210*a*, 210*b*, and first and second downhole zonal isolation assemblies 250*a*, 250*b*, are positioned within a wellbore casing 270 located in a wellbore 280, all of which are located within a subterranean formation 290. In the illustrated embodiment shown, the first and second downhole fracturing tool assemblies 210*a*, 210*b*, and first and second downhole zonal isolation assemblies 250*a*, 250*b* are deployed at first and second fracturing zones of interest 295*a*, 295*b* (e.g. similar to the fracturing zones of interest 175*a*, 175*b* of FIG. 1). For purposes of the present discussion, the first downhole fracturing tool assembly 210*a*, first zonal isolation assembly 250*a*, and first fracturing zone of interest 295*a* are uphole of the second downhole fracturing tool assembly 210*b*, second zonal isolation assembly 250*a*, and second fracturing zone of interest 295*a*, respectively. Accordingly, the first downhole fracturing tool assembly 210*a*, first zonal isolation assembly 250*a*, and first fracturing zone of interest 295*a* might be in a heel of the wellbore 290, whereas the second downhole fracturing tool assembly 210*b*, second zonal isolation assembly 250*a*, and second fracturing zone of interest 295*b* might be in a toe of the wellbore 290.

In accordance with one embodiment of the disclosure, the wellbore casing 270, at each of the fracturing zones of interest 295*a*, 295*b*, includes one or more fracturing ports 275*a*, 275*b* therein. The fracturing ports 275*a*, 275*b*, in this embodiment, provide a fluid path through the wellbore casing 270, as might be required to hydraulically fracture each of the fracturing zones of interest 295*a*, 295*b*. The number and location of the one or more fracturing ports 275*a*, 275*b* may vary greatly, for example based upon the design of the well system 200*a*.

In accordance with one embodiment of the disclosure, each of the first and second downhole fracturing tool assemblies 210*a*, 210*b* includes a fracturing port cover 215*a*, 215*b* coupled to an interior of the wellbore casing 270 proximate the one or more fracturing ports 275*a*, 275*b*. In accordance with this embodiment, the fracturing port covers 215*a*, 215*b* are operable to move between a first position sealing the one or more fracturing ports 275*a*, 275*b* from an interior of the wellbore casing 270 (see, for example fracturing port cover 215*a*) and a second position exposing the one or more fracturing ports 275*a*, 275*b* to the interior of the wellbore casing 270 (see, for example fracturing port cover 215*b*).

In accordance with one embodiment, the fracturing port covers 215*a*, 215*b* are sleeves lining at least a portion of the interior of the wellbore casing 270. For example, the sleeves may be sliding sleeves operable to linearly slide along a length of the wellbore casing 270, such as shown in FIG. 2A. Alternatively, the sleeves may be rotating sleeves operable to rotate about the interior of the wellbore casing 270. In either of these embodiments, the sleeves may move between the first position and the second position. In accordance with another embodiment, the fracturing port covers 215*a*, 215*b* are rotating ball valves movable between the first and second positions.

Figure 3A:
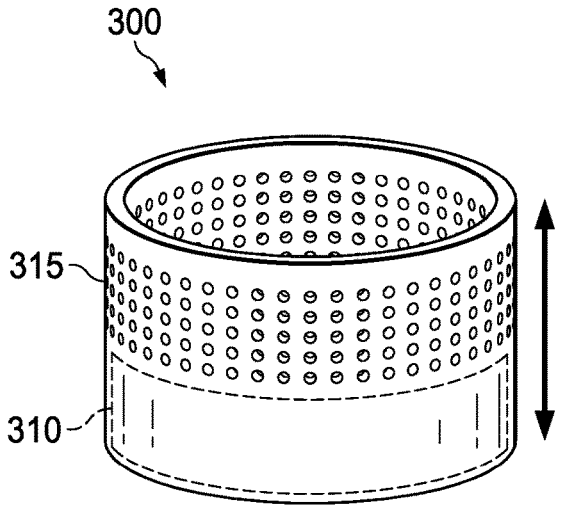
FIGS. 3A-3D illustrate detailed views of a first sliding sleeve, a second sliding sleeve, a rotating sleeve, and a rotating ball valve, each of which are designed, manufactured and operated according to the disclosure.
Figure 3B:
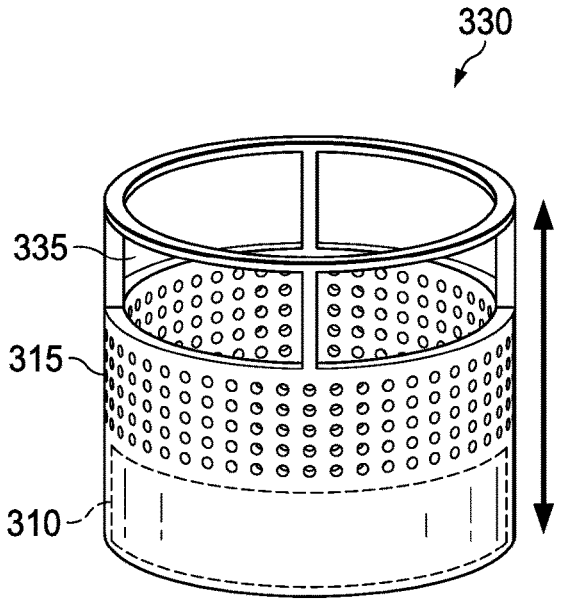
Figure 3C:
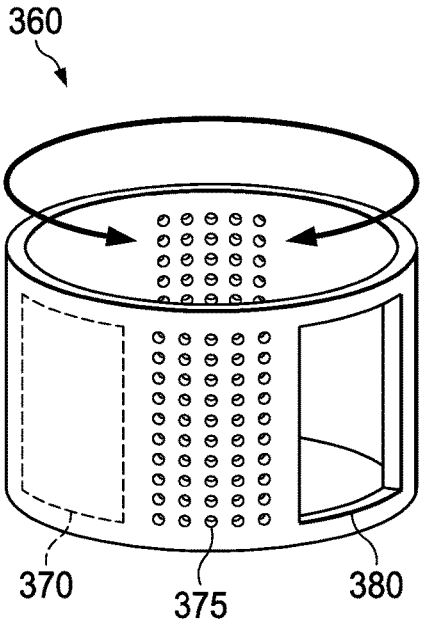

Turning briefly to FIGS. 3A-3C, illustrated are detailed views of a first sliding sleeve 300, a second sliding sleeve 330, and a rotating sleeve 360, respectively, each of which are designed, manufactured and operated according to the disclosure. With initial reference to FIG. 3A, the sliding sleeve 300, in the illustrated embodiment, has a fully closed region 310 for sealing the one or more fracturing ports, and a screen region 315 for holding proppant within the formation proximate the one or more fracturing ports. The screen region 315 may be small holes within the sliding sleeve 300, or alternatively slits, a fine mesh screen, a wire wrap, or a collection of granules, as is well known in the art, among other configurations. In the embodiment of FIG. 3A, the sliding sleeve 300 would be in the first position covering the one or more fracturing ports when the fully closed region 310 is positioned over the one or more fracturing ports, would be in the second position exposing the one or more fracturing ports when the sliding sleeve 300 is positioned entirely above or entirely below the one or more fracturing ports, and would be in a third position when the screen region 315 is positioned over the one or more fracturing ports.

With reference to FIG. 3B, the sliding sleeve 330 additionally includes a fully open region 335, which is in addition to the fully closed region 310 and the screen region 315 illustrated in FIG. 3A. In the embodiment of FIG. 3B, the sliding sleeve 330 would be in the first position covering the one or more fracturing ports when the fully closed region 310 is positioned over the one or more fracturing ports, would be in the second position exposing the one or more fracturing ports when the fully open region 335 is positioned over the one or more fracturing ports, and would be in the third position when the screen region 315 is positioned over the one or more fracturing ports. The sliding sleeve 300 and the sliding sleeve 330 primarily differ from one another in that the sliding sleeve 330 additionally includes the fully open region 335. It should be noted that the position of the fully closed region 310, screen region 315, and fully open region 335 in relation to each other may vary from that illustrated in FIGS. 3A and 3B. For example, the fully closed region 310 might be positioned in the middle between the screen region 315 and the fully open region 335, among other configurations.

With reference to FIG. 3C, the rotating sleeve 360 includes a fully closed region 370, a screen region 375, and a fully open region 380. In this embodiment, the rotating sleeve 360 would rotate about a central axis thereof, for example to position the different regions of the rotating sleeve 360 relative to the one or more fracturing ports in the wellbore casing. In the embodiment of FIG. 3C, the rotating sleeve 360 would be in the first position covering the one or more fracturing ports when the fully closed region 370 is positioned over the one or more fracturing ports, would be in the second position exposing the one or more fracturing ports when the fully open region 380 is positioned over the one or more fracturing ports, and would be in the third position when the screen region 375 is positioned over the one or more fracturing ports. Again, the position of the fully closed region 370, screen region 375, and fully open region 380, in relation to each other, may vary from that illustrated in FIG. 3C.

Figure 3D:
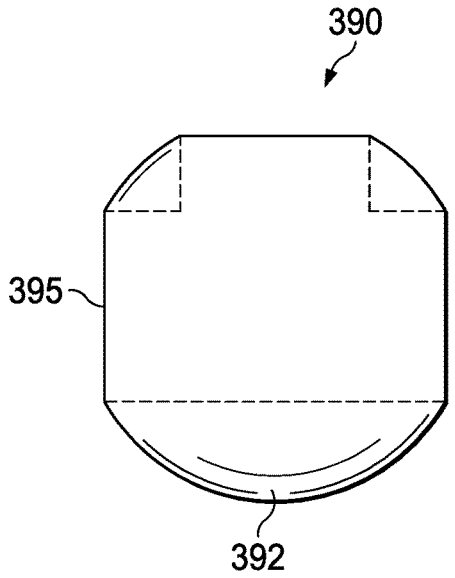

Turning briefly to FIG. 3D, illustrated is an embodiment of a rotating ball valve 390 that might be used as a fracturing port cover, such as the fracturing port covers 215*a*, 215*b* illustrated in FIG. 2A. The rotating ball valve 390, in this embodiment, includes a fully closed region 392 and a fully open region 395. In the embodiment of FIG. 3D, the rotating ball valve 390 would be in the first position covering the one or more fracturing ports when the fully closed region 392 is positioned over the one or more fracturing ports, and would be in the second position exposing the one or more fracturing ports when the fully open region 395 is positioned over the one or more fracturing ports.

Returning to FIG. 2A, the downhole fracturing tool assemblies 210*a*, 210*b* additionally include fracturing port cover actuators 220*a*, 220*b*, coupled to the fracturing port covers 210*a*, 210*b*, respectively. The fracturing port cover actuators 220*a*, 220*b*, in this embodiment, are operable to move the fracturing port covers 210*a*, 210*b*, between the first position sealing the one or more fracturing ports 275*a*, 275*b* from an interior of the wellbore casing 270 and the second position exposing the one or more fracturing ports 275*a*, 275*b* to the interior of the wellbore casing 270. The fracturing port cover actuators 220*a*, 220*b* are additionally operable to move the fracturing port covers 210*a*, 210*b* to the third position (e.g., screen position discussed above), when necessary.

The fracturing port cover actuators 220*a*, 220*b* may comprise many different designs and remain with the scope of the disclosure. Essentially, any actuator that is capable of moving the fracturing port covers 210*a*, 210*b* between the first, second and possibly third positions may be used. In certain embodiments, the fracturing port cover actuators 220*a*, 220*b* may be capable of moving the fracturing port covers 210*a*, 210*b* back and forth between the first, second and possibly third positions. In one specific embodiment, the fracturing port cover actuators 220*a*, 220*b* are electric actuators, such as for example a motor with a ball screw, among others. In another embodiment, the fracturing port cover actuators 220*a*, 220*b* are hydraulic or pneumatic actuators, and in yet another embodiment the fracturing port cover actuators 220*a*, 220*b* are chemical reaction actuators (e.g., gas generator). In yet another embodiment, an electronic rupture disc and an atmospheric chamber could be used as the fracturing port cover actuators 220*a*, 220*b*. Again, while only a few example embodiments of fracturing port cover actuators 220*a*, 220*b* have been given, those skilled in the art understand that many other fracturing port cover actuators 220*a*, 220*b* are within the scope of the disclosure. The downhole fracturing tool assemblies 210*a*, 210*b* illustrated in FIG. 2A additionally include fracturing port cover electronics 225*a*, 225*b* coupled to the fracturing port cover actuators 220*a*, 220*b* proximate the fracturing port covers 210*a*, 210*b*.

In the embodiment of FIG. 2A, the fracturing port cover electronics 225*a*, 225*b* are operable (e.g., programmed in one embodiment) to activate the fracturing port cover actuators 220*a*, 220*b*, for example to move the fracturing port covers 210*a*, 210*b* between the first, second and possibly third positions. The fracturing port cover electronics 225*a*, 225*b* may be programmed to activate the fracturing port cover actuators 220*a*, 220*b* based upon variety of different criteria. In one embodiment, the fracturing port cover electronics 225*a*, 225*b* are programmed to activate the fracturing port cover actuators 220*a*, 220*b* based upon changes in time. In another embodiment, the fracturing port cover electronics 225*a*, 225*b* are programmed to activate the fracturing port cover actuators 220*a*, 220*b* based upon changes in temperature (e.g., as the temperatures rise and fall as the well system undergoes different fracturing processes), or based upon changes in pressure (e.g., as the pressures rise and fall as the well system undergoes different fracturing processes), or even based upon changes in flow (e.g., as the flow of the fluid increases and decreases as the well system undergoes different fracturing processes).

In yet another embodiment, the fracturing port cover electronics 225*a*, 225*b* may be programmed to activate the fracturing port cover actuators 220*a*, 220*b* based upon receiving a signal. For example, the fracturing port cover electronics 225*a*, 225*b* may be programmed to activate the fracturing port cover actuators 220*a*, 220*b* based upon receiving a signal encoded on the wellbore casing 270 or within fluid within the wellbore casing 270. In yet another embodiment, the fracturing port cover electronics 225*a*, 225*b* are programmed to activate the fracturing port cover actuators 220*a*, 220*b* based upon receiving a signal from a drop ball or drop plug traversing down the wellbore casing 270. In yet other embodiments, combinations of the above may be used. While a handful of different embodiments have been given regarding the fracturing port cover electronics 225*a*, 225*b*, and specifically what they activate the fracturing port cover actuators 220*a*, 220*b* based upon, unless otherwise required the present disclosure should not be limited to such. The downhole fracturing tool assemblies 210*a*, 210*b* illustrated in FIG. 2A additionally include power sources 230*a*, 230*b* coupled to the fracturing port cover electronics 225*a*, 225*b* proximate the fracturing port cover 210*a*, 210*b*.

In accordance with the disclosure, the power sources 230*a*, 230*b* are operable to power the fracturing port cover electronics 225*a*, 225*b*. In accordance with one embodiment, the power sources 230*a*, 230*b* are downhole battery sources. In one embodiment, the downhole battery source is a primary battery. In a second embodiment, the downhole battery is a secondary battery. In a third embodiment, the downhole battery is a combination of primary and secondary batteries. In this embodiment, the downhole battery sources would have enough power to move the fracturing port covers 210*a*, 210*b* between the first, second and optionally third positions at least one time, if not a handful of times or longer. In other embodiments, the downhole battery sources are a first power source, and the downhole fracturing tool assemblies 210*a*, 210*b* each include a second power source 235*a*, 235*b*. In accordance with this example, the second power sources 235*a*, 235*b* could be fluid flow power sources, such as a turbine generator. The second power sources 235*a*, 235*b* have the added benefit that they can continue to power the fracturing port cover electronics 225*a*, 225*b*, even after the downhole battery sources have been depleted.

In those embodiments wherein the second power sources 235*a*, 235*b* are fluid flow power sources, one or more fluid ports 240*a*, 240*b* may couple a throat of the fracture proximate the one or more fracturing ports 275*a*, 275*b* and the fluid flow power sources. Accordingly, fluid from the fracture may be used to generate power for the fracturing port cover electronics 225*a*, 225*b*, among other powered devices. Furthermore, the fracturing port covers 215*a*, 215*b* may be operable to redirect fluid to the fluid flow power source via the fluid port 240*a*, 240*b*, and thus determine when and how much energy is generated by the second power sources 235*a*, 235*b*.

In accordance with one embodiment of the disclosure, the first and second downhole zonal isolation assemblies 250*a*, 250*b* include rotating fracturing valves 255*a*, 255*b* positionable within the wellbore casing 270 proximate the fracturing zones of interest 295*a*, 295*b*. The rotating fracturing valves 255*a*, 255*b*, in contrast to many downhole valves that may exist today, are operable to isolate fluid from travelling downhole, as opposed to seal fluid from travelling uphole. Moreover, the rotating fracturing valves 255*a*, 255*b* are located proximate a fracturing zone of interest, as opposed to proximate an uppermost portion of the wellbore 280.

The rotating fracturing valves 255*a*, 255*b*, in accordance with the disclosure, are operable to move from a first wellbore casing 270 open position (e.g., as shown with the rotating fracturing valve 255*a*) to a second wellbore casing 270 closed position (e.g., as shown with the rotating fracturing valve 255*b*). The rotating fracturing valves 255*a*, 255*b* may embody many different designs and remain within the scope of the disclosure. In the embodiment illustrated in FIG. 2A, the rotating fracturing valves 255*a*, 255*b* are rotating flapper valves that move between the wellbore casing 270 open position and the wellbore casing 270 closed position. In another embodiment, not shown, the rotating fracturing valves 255*a*, 255*b* are rotating ball valves. The rotating ball valves would be similar in many, but not all, respects to the rotating ball valve 390 illustrated in FIG. 3D above.

In certain embodiments, the rotating fracturing valves 255*a*, 255*b*, are operable to move back and forth between the wellbore casing 270 open position and the wellbore casing 270 closed position, for example using a spring or another power source. In other embodiments, the rotating fracturing valves 255*a*, 255*b* may only move between the wellbore casing 270 open position and the wellbore casing 270 closed position a single time, or vice versa. In those embodiments wherein the rotating fracturing valves 255*a*, 255*b* may not return to the wellbore casing 270 open position, they may comprise a dissolvable material. Alternatively, the rotating fracturing valves 255*a*, 255*b* may be physically removed, for example by being drilled out, in those embodiments wherein the rotating fracturing valves 255*a*, 255*b* may not return to the wellbore casing 270 open position.

In accordance with one embodiment of the disclosure, the first and second downhole zonal isolation assemblies 250*a*, 250*b* include rotating fracturing valve actuators 260*a*, 260*b* coupled to the rotating fracturing valves 255*a*, 255*b*, respectively. The rotating fracturing valve actuators 260*a*, 260*b* may comprise many different designs and remain within the scope of the disclosure. In one embodiment, the rotating fracturing valve actuators 260*a*, 260*b* are release mechanisms, that when released allow fluid within the wellbore casing 270 to move the rotating fracturing valves 255*a*, 255*b* from the first wellbore casing 270 open position to the second wellbore casing 270 closed position. In another embodiment, a combination of the release mechanism and a spring moves the rotating fracturing valves 255*a*, 255*b* from the first wellbore casing 270 open position to the second wellbore casing 270 closed position. In other embodiments, the rotating fracturing valve actuators 260*a*, 260*b* are electric actuators, such as for example a motor with a ball screw among others. In another embodiment, the rotating fracturing valve actuators 260*a*, 260*b* are hydraulic or pneumatic actuators, and in yet another embodiment the rotating fracturing valve actuators 260*a*, 260*b* are chemical reaction actuators (e.g., gas generators), among others.

In the embodiment of FIG. 2A, rotating fracturing valve electronics 262*a*, 262*b* are operable (e.g., programmed in certain embodiments) to activate the rotating fracturing valve actuators 260*a*, 260*b*, for example to move the rotating fracturing valves 255*a*, 255*b* from the first wellbore casing 270 open position to the second wellbore casing 270 closed position. The rotating fracturing valve electronics 262*a*, 262*b* may be programmed to activate the rotating fracturing valve actuators 260*a*, 260*b* based upon variety of different criteria. In one embodiment, the rotating fracturing valve electronics 262*a*, 262*b* are programmed to activate the rotating fracturing valve actuators 260*a*, 260*b* based upon changes in time. In another embodiment, the rotating fracturing valve electronics 262*a*, 262*b* are programmed to activate the rotating fracturing valve actuators 260*a*, 260*b* based upon changes in temperature (e.g., as the temperatures rise and fall as the well system undergoes different fracturing processes), or based upon changes in pressure (e.g., as the pressures rise and fall as the well system undergoes different fracturing processes), or even based upon changes in flow (e.g., as the flow of the fluid increases and decreases as the well system undergoes different fracturing processes). In yet another embodiment, the rotating fracturing valve electronics 262*a*, 262*b* are programmed to activate the rotating fracturing valve actuators 260*a*, 260*b* based upon receiving a signal. For example, the rotating fracturing valve electronics 262*a*, 262*b* are programmed to activate the rotating fracturing valve actuators 260*a*, 260*b* based upon receiving a signal encoded on the wellbore casing 270 or within fluid within the wellbore casing 270. In yet another embodiment, the rotating fracturing valve electronics 262*a*, 262*b* are programmed to activate the rotating fracturing valve actuators 260*a*, 260*b* based upon receiving a signal from a drop ball or drop plug traversing down the wellbore casing 270. In yet other embodiments, combinations of the above may be used. While a handful of different embodiments have been given regarding the rotating fracturing valve electronics 262*a*, 262*b*, and specifically what they activate the rotating fracturing valve actuators 260*a*, 260*b* based upon, unless otherwise required the present disclosure should not be limited to such. The first and second downhole zonal isolation assemblies 250*a*, 250*b* illustrated in FIG. 2A additionally include power sources 264*a*, 264*b* coupled to the rotating fracturing valve electronics 262*a*, 262*b* proximate the rotating fracturing valves 255*a*, 255*b*.

In accordance with the disclosure, the power sources 264*a*, 264*b* are operable to power the rotating fracturing valve electronics 262*a*, 262*b*. In accordance with one embodiment, the power sources 264*a*, 264*b* are downhole battery sources. In this embodiment, the downhole battery sources would have enough power to move the rotating fracturing valves 255*a*, 255*b* from the first wellbore casing 270 open position to the second wellbore casing 270 closed position at least a single time. In another embodiment, the rotating fracturing valve electronics 262*a*, 262*b* are powered by the second power sources 235*a*, 235*b*.

Figure 2B:
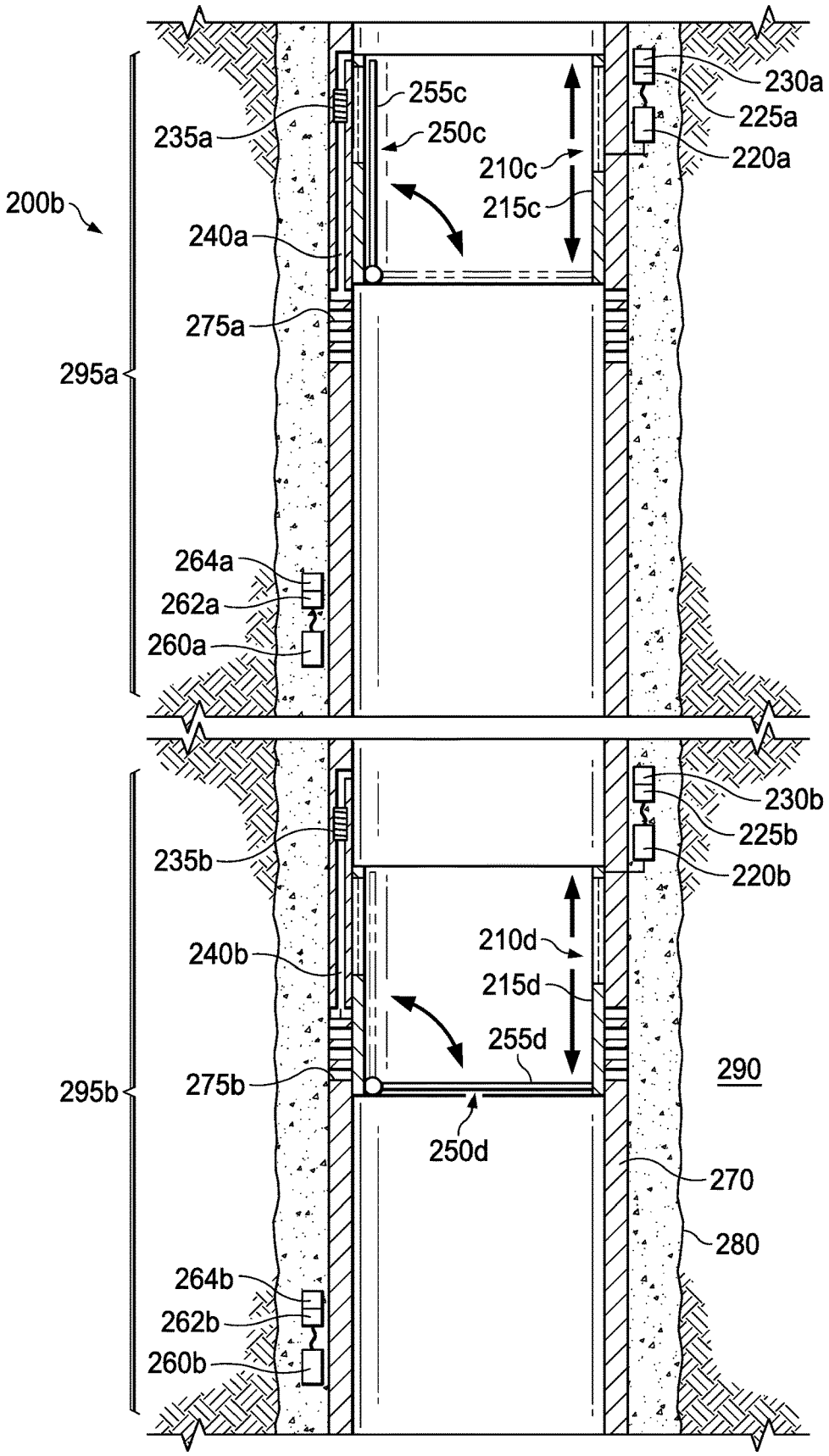

Turning now to FIG. 2B, schematically illustrated is an alternative well system 200*b* designed, manufactured, and operated according to one embodiment of the disclosure. The well system 200*b* is similar in many respects to the well system 200*a* illustrated and described with respect to FIG. 2A. Accordingly, like reference number have been used to reference similar, if not identical, features. The well system 200*b* differs, for the most part, from the well system 200*a*, in that the rotating fracturing valves 250*c*, 250*d* are mechanically coupled to their associated fracturing port covers 210*c*, 210*d*. Accordingly, the fracturing port cover 210*c* moves with the rotating fracturing valve 250*c*, and the fracturing port cover 210*d* moves with the rotating fracturing valve 250*c*. For example, the rotating fracturing valves 250*c*, 250*d* could hinge from their associated fracturing port covers 210*c*, 210*d*. Given this configuration, an activation (e.g., closing) of the rotating fracturing valve 250*c* will slide the fracturing port cover 210*c* down, and thus close the fracturing ports 275*a*. Similarly, an activation (e.g., closing) of the rotating fracturing valve 250*d* will slide the fracturing port cover 210*d* down, and thus close the fracturing ports 275*b*.

In the illustrated embodiment shown in FIG. 2B, the rotating fracturing valve 250*d* has been moved from the first wellbore casing open position to the second wellbore casing closed position. With the rotating fracturing valve 250*d* in the closed position, fluid pressure on the flapper of the rotating fracturing valve 250*d* causes the fracturing port cover 210*d* to move from a position exposing the one or more fracturing ports 275*b* to the interior of the wellbore casing to a position sealing the one or more fracturing ports 275*b* from an interior of the wellbore casing. Such activation will often be conducted in a toe to heel configuration.

Turning to FIGS. 4A-4G, illustrated are schematic views of one embodiment for fracturing a well system 400, the well system 400 is similar in many respects to the well system 200*a* discussed above with regard to FIG. 2A. Accordingly, like reference numbers have been used to indicate similar, if not identical, features. In the method discussed with regard to FIGS. 4A-4G, the well system 400 will be fractured in a toe to heel order. Notwithstanding, other embodiments exist wherein the well system 400 is fractured in a heel to toe order. Such a heel to toe fracturing process would likely not use the zonal isolation assemblies, but would in turn use multiple downhole fracturing tool assemblies to provide the zonal isolation, such as described below with respect to FIGS. 5A-5G.

Figure 4A:
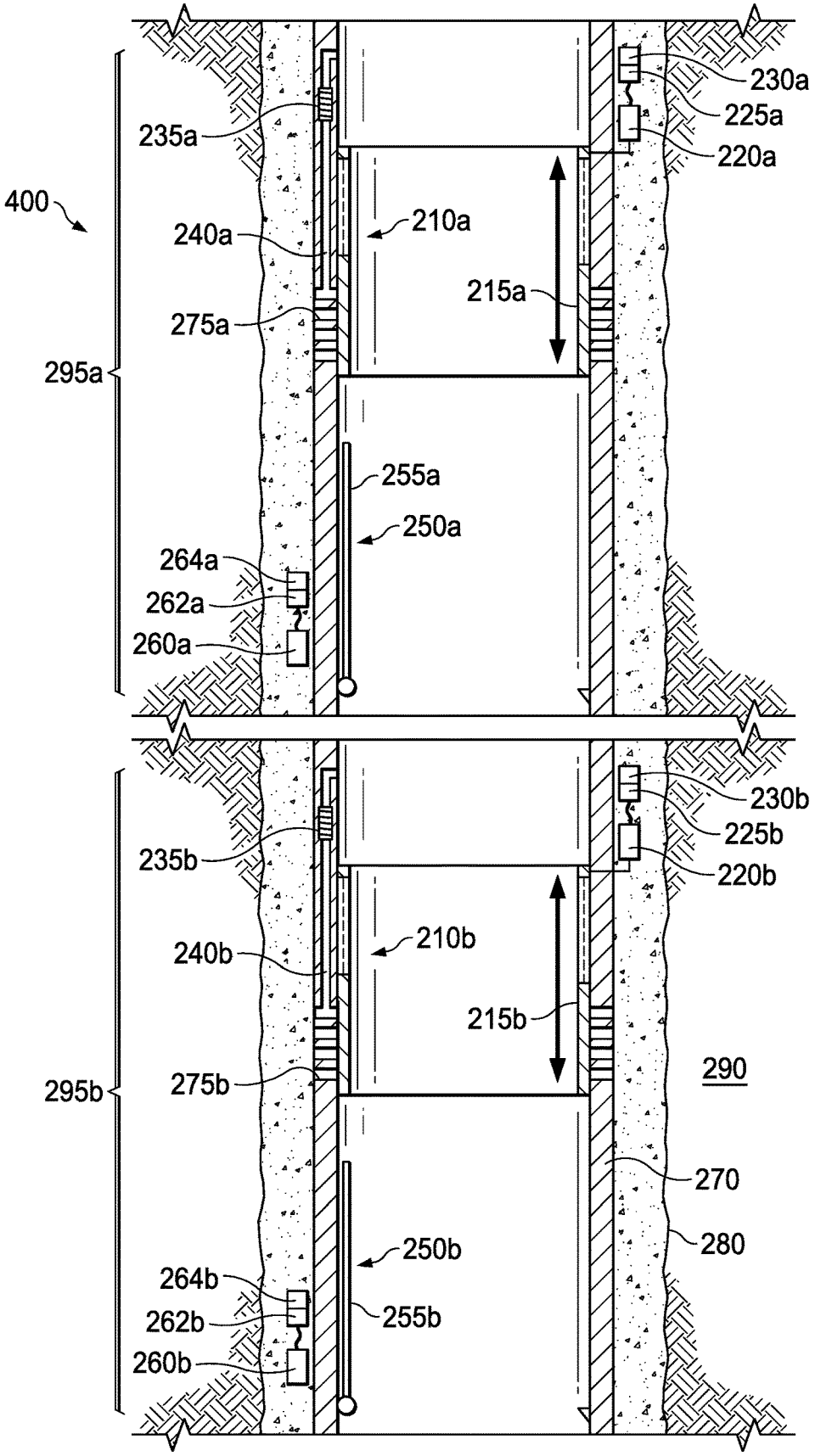
FIGS. 4A-4G illustrate schematic views of one embodiment of a method for fracturing a well system.

With initial reference to FIG. 4A, the method begins with the first and second fracturing port covers 215*a*, 215*b* in the first position sealing the one or more fracturing ports 275*a*, 275*b*. Additionally, the first and second rotating fracturing valves 255*a*, 255*b*, are in the first wellbore 270 casing open position. This position of the first and second fracturing port covers 215*a*, 215*b* and first and second rotating fracturing valves 255*a*, 255*b* may be similar to the run-in-hole position for the downhole fracturing tool assemblies 210*a*, 210*b* and downhole zonal isolation assemblies 250*a*, 250*b*.

Figure 4B:
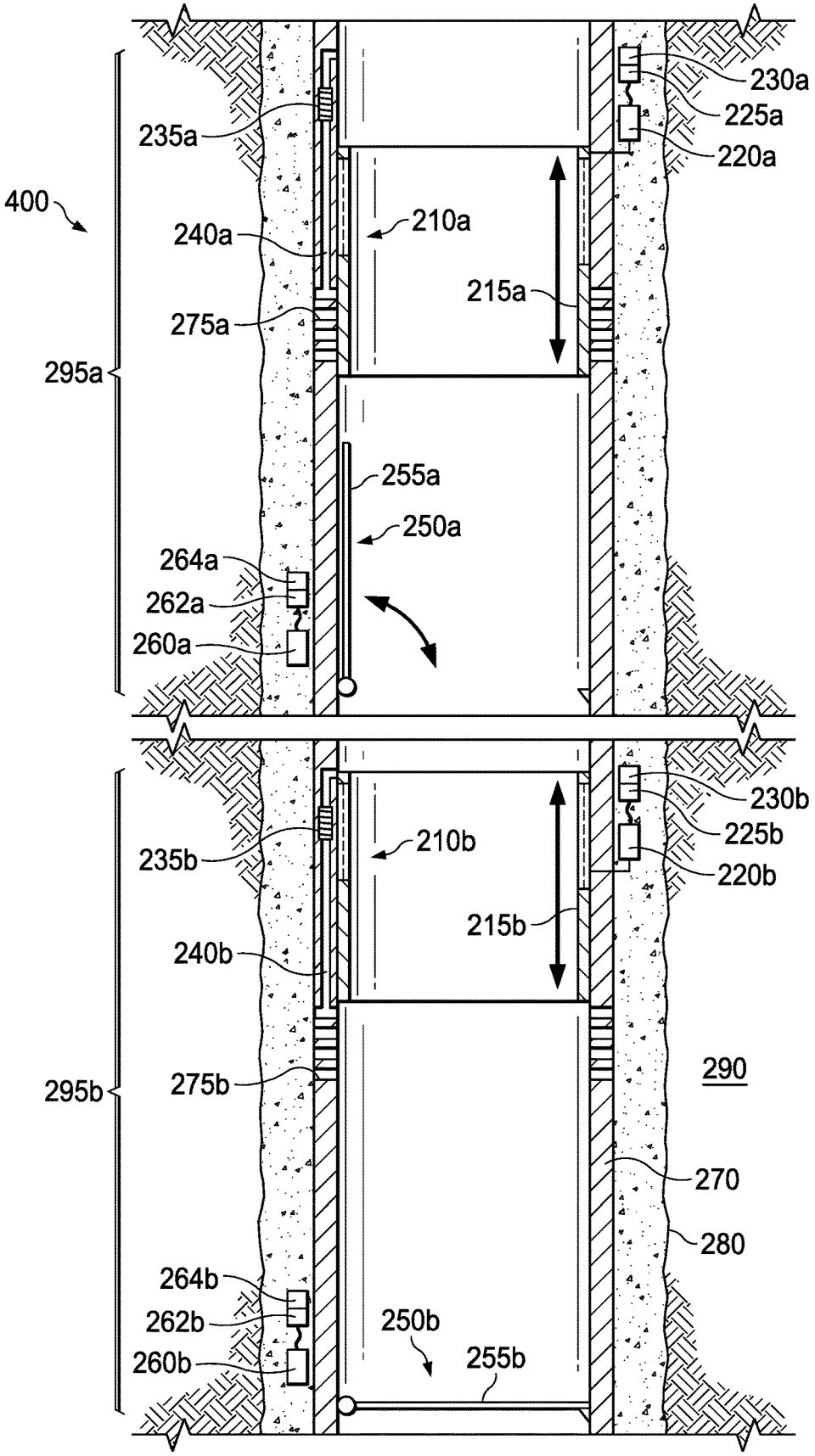

Turning to FIG. 4B, illustrated is the well system 400 of FIG. 4A after beginning the fracturing process of the second fracturing zone of interest 295*b*. As shown, the second fracturing port cover 215*b* has been moved to the second position exposing the one or more fracturing ports 275*b*, while the first fracturing port cover 215*a* remains in the first position sealing the one or more fracturing ports 275*a*. Similarly, the second rotating fracturing valve 255*b* has been moved to the second wellbore casing 270 closed position, while the first rotating fracturing valve 255*a* remains in the first wellbore casing 270 open position. Accordingly, the second fracturing zone of interest 295*b* is isolated from any zones there below using the second rotating fracturing valve 255*b*, and isolated from the first fracturing zone of interest using the first fracturing port cover 215*a*.

The second fracturing port cover 215*b* and second rotating fracturing valve 255*b* may be moved from their respective first positions to their respective second positions using the second fracturing port actuator 220*b* and second rotating fracturing valve actuator 260*b*, respectively. Moreover, the second fracturing port actuator 220*b* and second rotating fracturing valve actuator 260*b* may be activated by the fracturing port cover electronics 225*b* and rotating fracturing valve electronics 262*b*, respectively, based upon any of the criteria discussed above, among other criteria.

It should be apparent that the second rotating fracturing valve 255*b* is optional. The well system of FIG. 4B has a flow path from the interior of the tubing to the formation through open fracturing ports 275*b* and now flow path through obscured fracturing ports 275*a*. Thus, all of the fluid will exit through fracturing ports 275*b*. The rotating fracturing valve 255*b* and 255*a* are optional in order to help direct the flow towards the open fracturing ports.

Figure 4C:
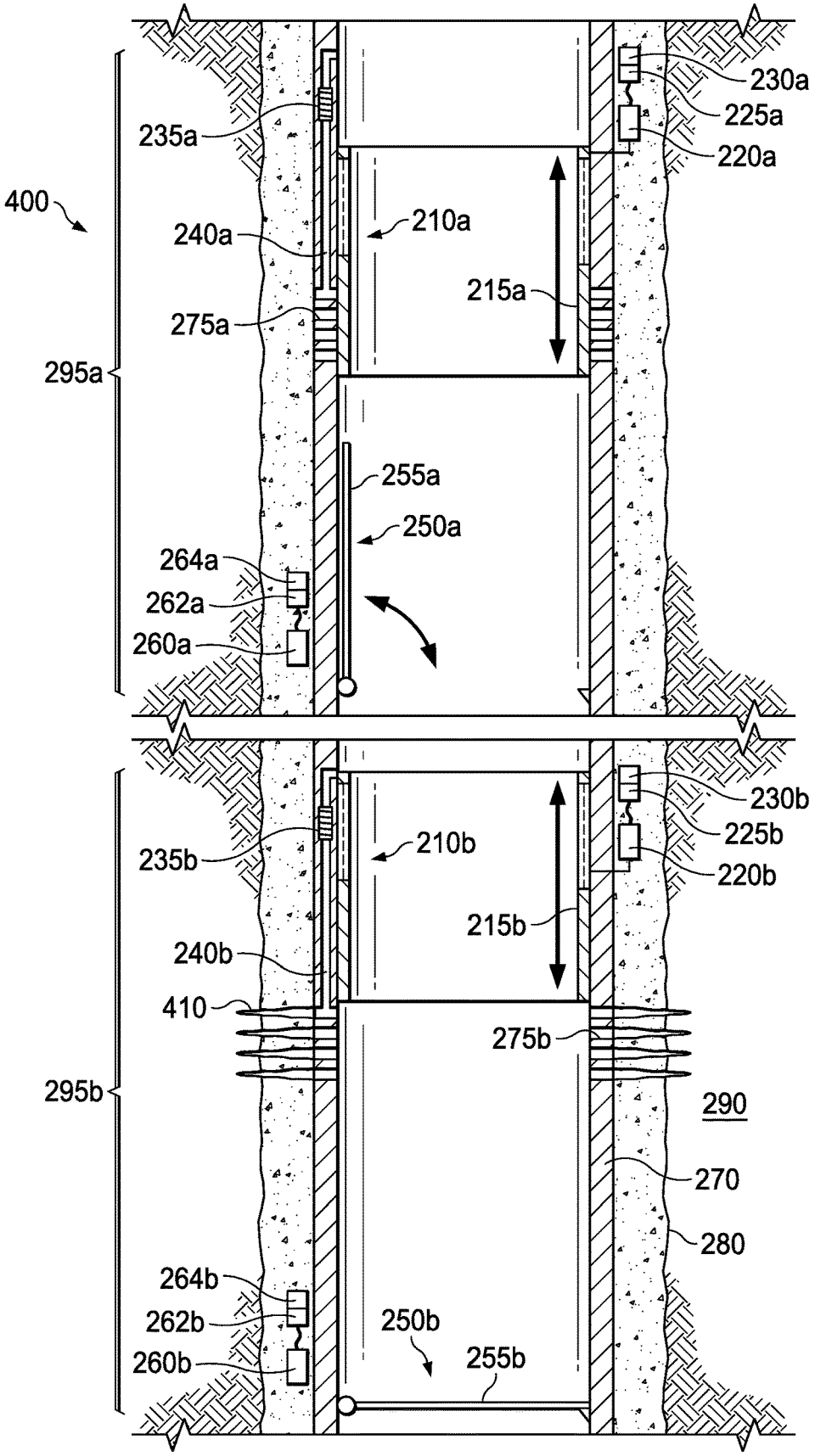

Turning to FIG. 4C, illustrated is the well system 400 of FIG. 4B after fracturing the second zone of interest 295*b*. Ultimately, the fracturing of the second zone of interest 295*b* introduces fractures 410 within the subterranean formation 290 proximate the fracturing ports 275*b*. Those skilled in the art understand the process of fracturing the second zone of interest 295*b*, including subjecting the exposed second zone of interest 295*b* to high pressure fluid, which may or may not contain proppant therein.

Figure 4D:
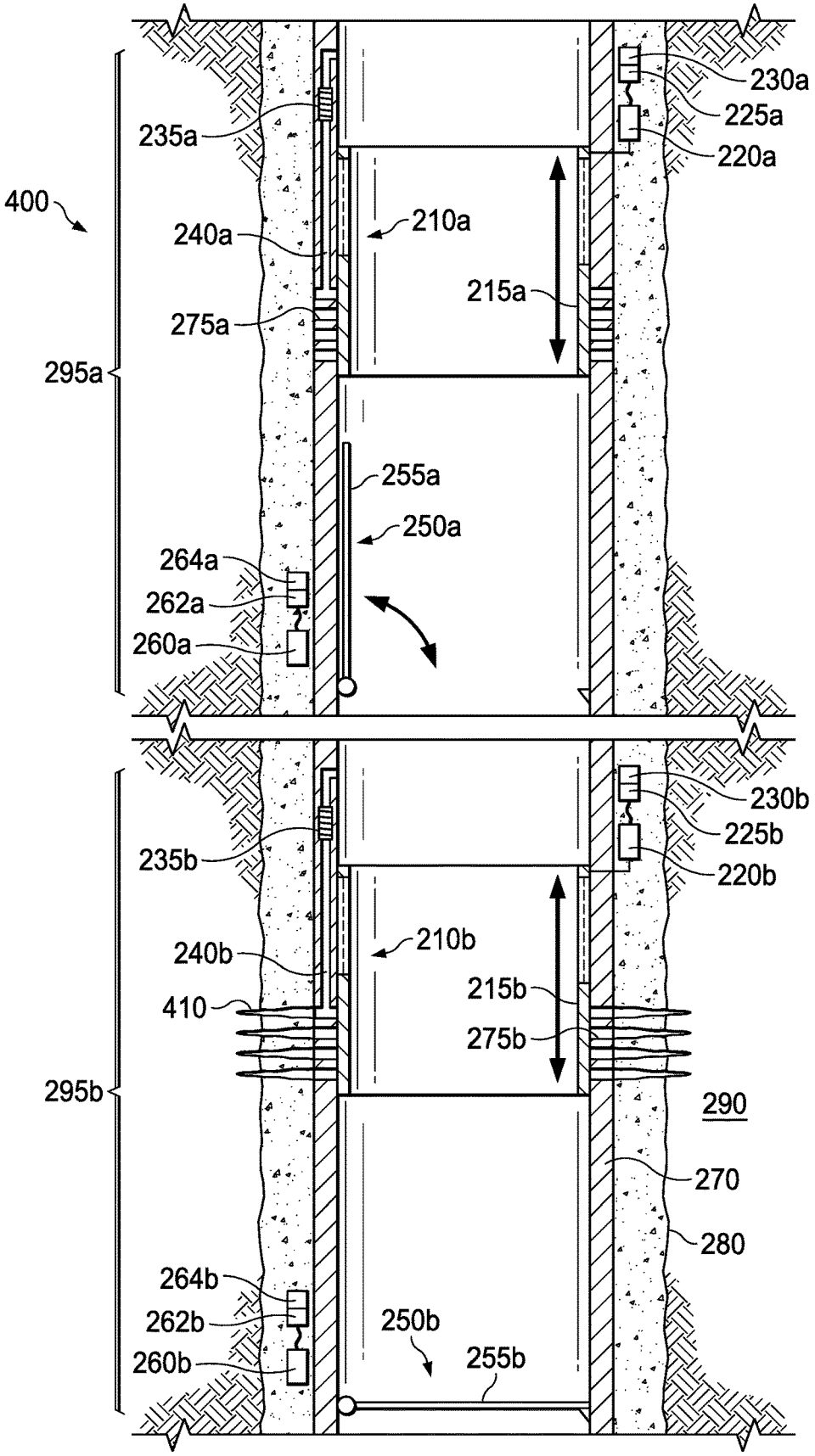

Turning to FIG. 4D, illustrated is the well system 400 of FIG. 4C after the optional step of moving the second fracturing port cover 215*b* back to the first position sealing the one or more fracturing ports 275*b*. If the second fracturing port cover 215*b* seals fracturing ports 275*b*, then rotating fracturing valve 255*a* might be optional. In another embodiment, the second fracturing port cover 215*b* could be moved to the third position, such that the screen region is over the one or more fracturing ports 275, thereby holding proppant within the formation 290. In yet another embodiment, the second fracturing port cover 215*b* could remain in the second position exposing the one or more fracturing ports 275*b*.

Figure 4E:
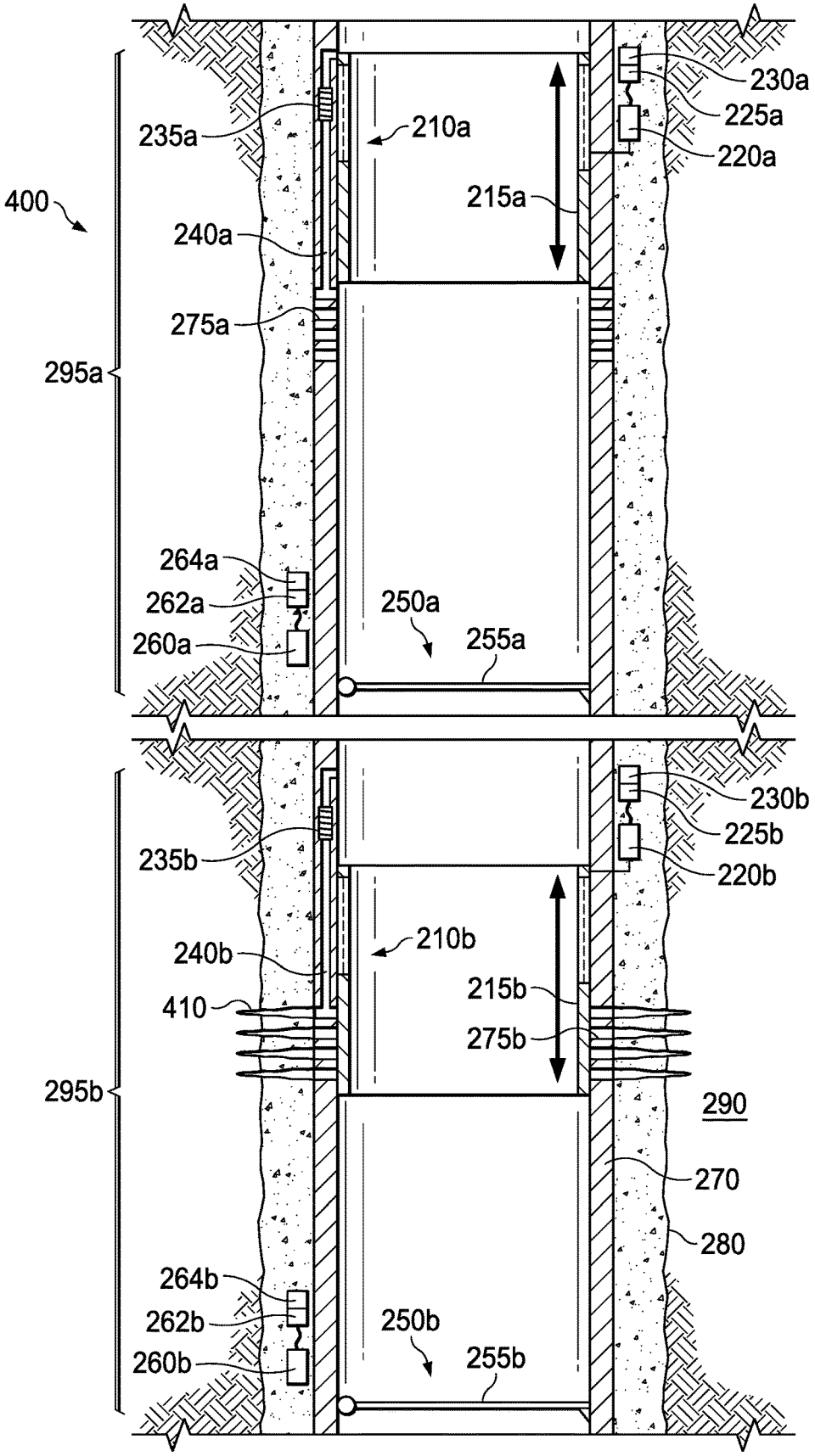

Turning to FIG. 4E, illustrated is the well system 400 of FIG. 4D after the first fracturing port cover 215*a* has been moved to the second position exposing the one or more fracturing ports 275*a*, and the first rotating fracturing valve 255*a* has been moved to the second wellbore casing 270 closed position. Accordingly, the first fracturing zone of interest 295*a* is isolated from any zones there below using the first rotating fracturing valve 255*a*. The first fracturing port cover 215*a* and first rotating fracturing valve 255*a* may be moved from their respective first positions to their respective second positions using the first fracturing port actuator 220*a* and first rotating fracturing valve actuator 260*a*, respectively. Moreover, the first fracturing port actuator 220*a* and first rotating fracturing valve actuator 260*a* may be activated by the fracturing port cover electronics 225*a* and rotating fracturing valve electronics 262*a*, respectively, based upon any of the criteria discussed above, among other criteria.

Figure 4F:
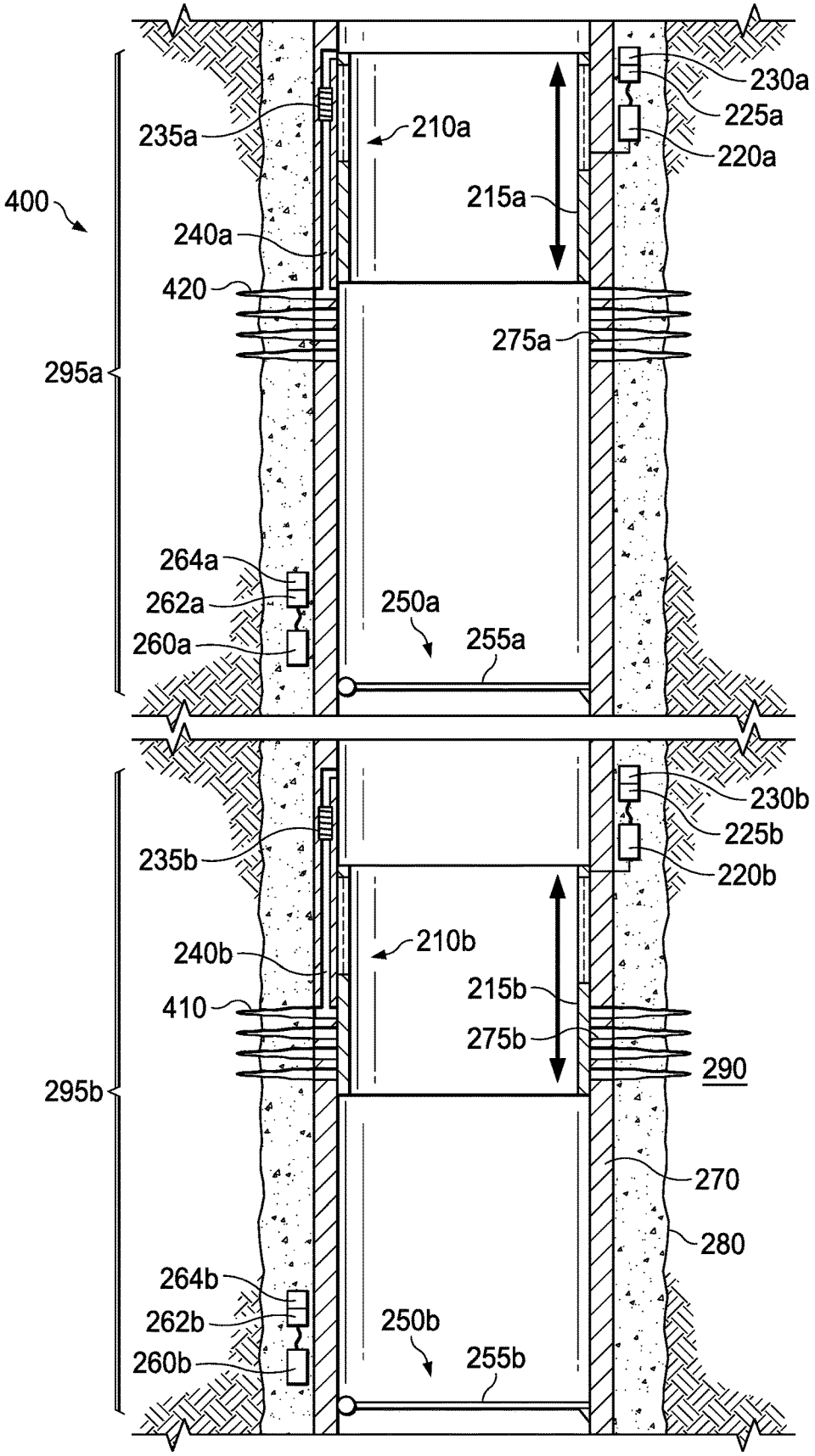

Turning to FIG. 4F, illustrated is the well system 400 of FIG. 4E after fracturing the first zone of interest 295*a*. Ultimately, the fracturing of the first zone of interest 295*a* introduces fractures 420 within the subterranean formation 290 proximate the fracturing ports 275*a*. Those skilled in the art understand the process of fracturing the first zone of interest 295*a*, including subjecting the exposed first zone of interest 295*a* to high pressure fluid, which may or may not contain proppant therein.

Figure 4G:
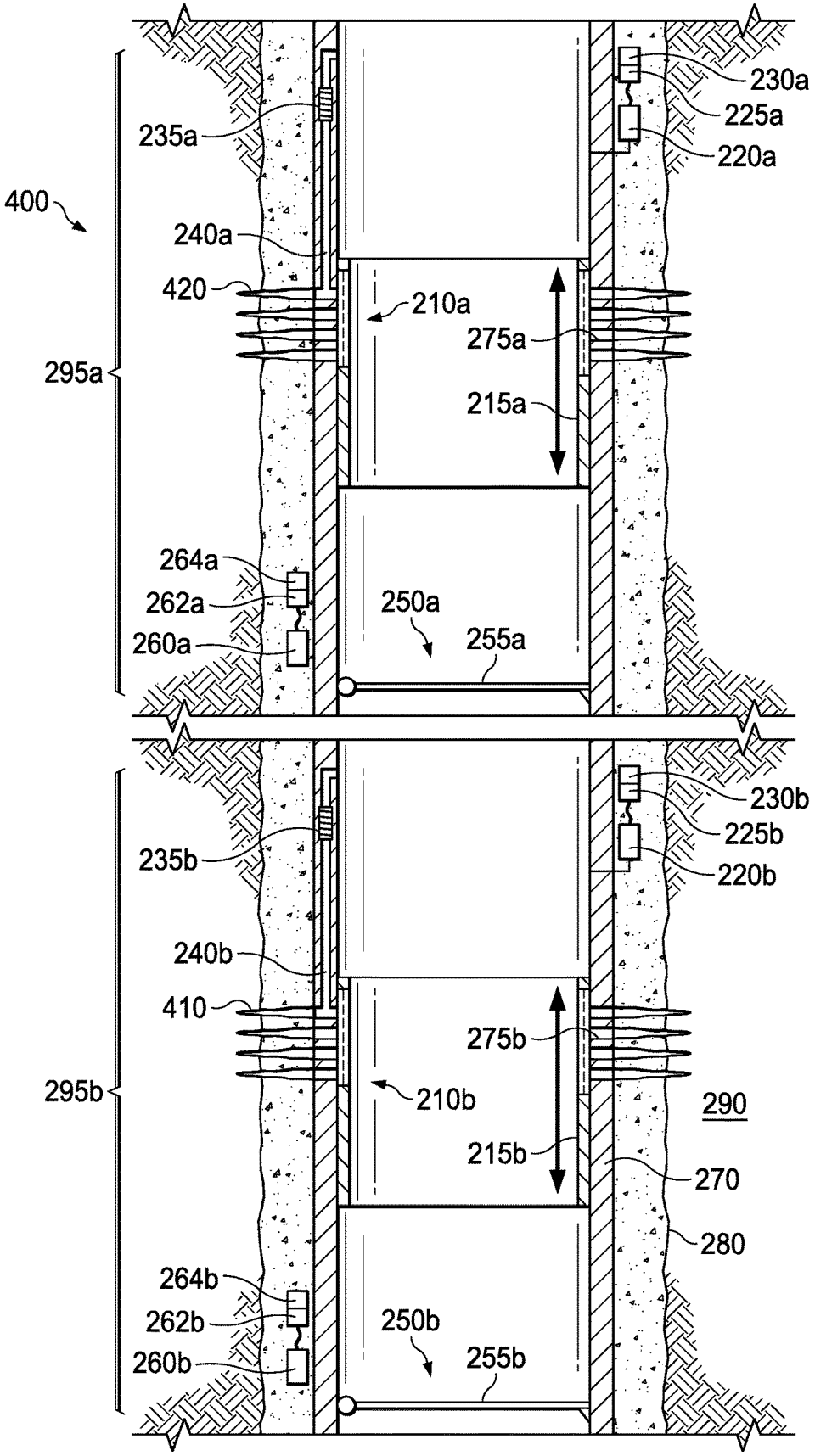

Turning to FIG. 4G, illustrated is the well system 400 of FIG. 4F after the optional step of moving the first and second port covers 215*a*, 215*b* to their respective third positions, such that the screen regions of the first and second port covers 215*a*, 215*b* are over the one or more fracturing ports 275*a*, 275*b*, respectively. Accordingly, the screen regions of the first and second port covers 215*a*, 215*b* hold the proppant within the formation 290.

While not discussed in detail above, the first and second downhole fracturing tool assemblies 210*a*, 210*b* may be operated as a flow restrictor, such as an inflow control device (ICD), autonomous inflow control device (AICD), or autonomous inflow control valve (AICV). Accordingly, after fracturing, and during or after production, the first and second downhole fracturing tool assemblies 210*a*, 210*b* may be used to control the production from the first and second fracturing zones of interest 295*a*, 295*b*. For example, not only can the first and second downhole fracturing tool assemblies 210*a*, 210*b* completely close one or both of the first and second fracturing zones of interest 295*a*, 295*b*, in certain other embodiments the first and second downhole fracturing tool assemblies 210*a*, 210*b* may squeeze the production from one or both of the first and second fracturing zones of interest 295*a*, 295*b*. Furthermore, as this process may occur many months if not years after fracturing the first and second fracturing zones of interest 295*a*, 295*b*, the second fluid flow power sources 235*a*, 235*b* may be used to provide power to the first and second downhole fracturing tool assemblies 210*a*, 210*b*.

Turning to FIGS. 5A-5G, illustrated are schematic views of one embodiment for fracturing a well system 500, the well system 500 similar in many respects to the well system 200*a* discussed above with regard to FIG. 2A. Accordingly, like reference numbers have been used to indicate similar, if not identical, features. The well system 500 differs, for the most part, from the well system 400 of FIGS. 4A-4G, in that the well system 500 does not include the first and second downhole zonal isolation assemblies 250*a*, 250*b*. Accordingly, the well system 500 may be fractured in a heel to toe order.

Figure 5A:
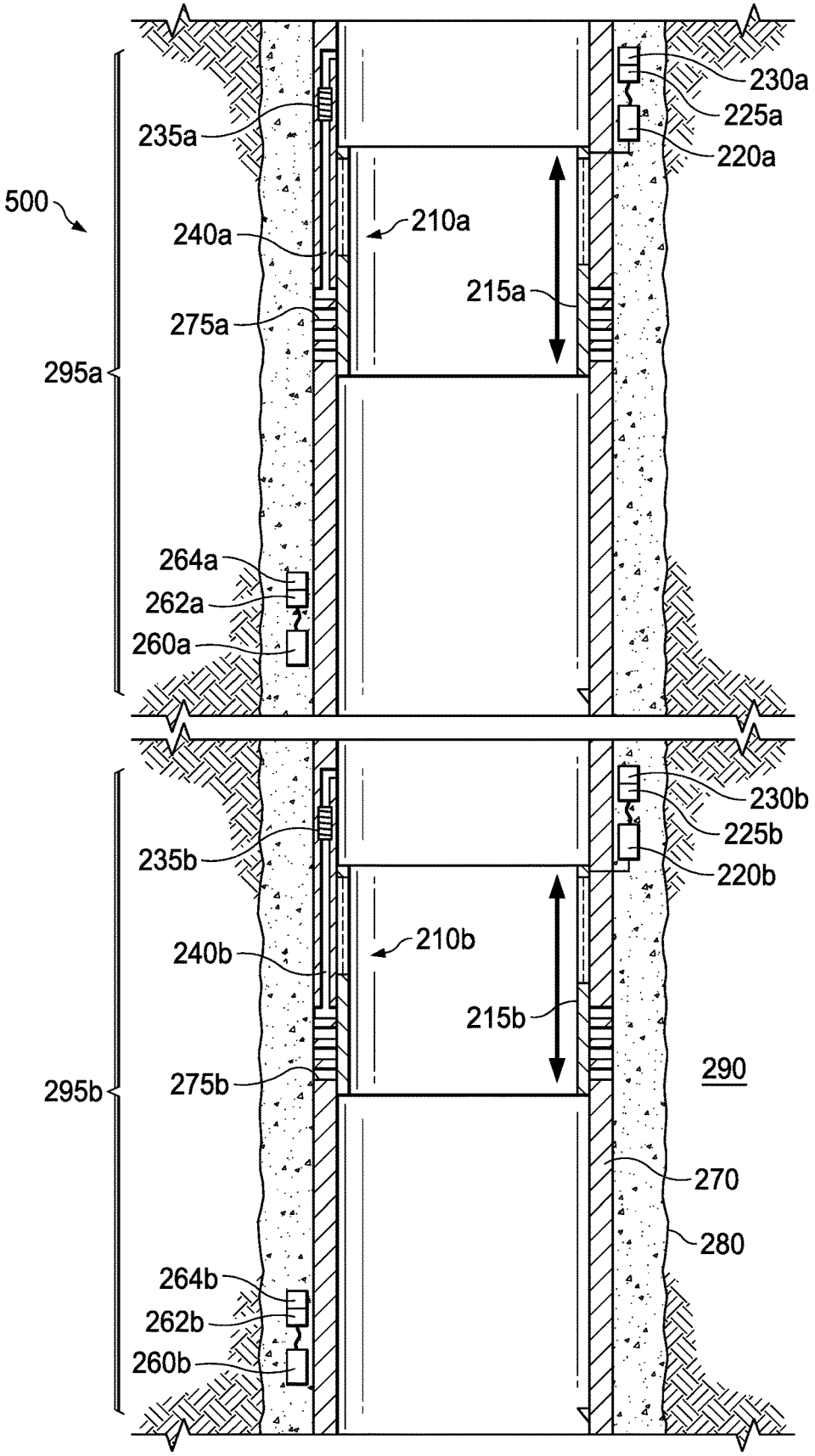
FIGS. 5A-5G illustrate schematic views of another embodiment of a method for fracturing a well system.

With initial reference to FIG. 5A, the method begins with the first and second fracturing port covers 215*a*, 215*b* in the first position sealing the one or more fracturing ports 275*a*, 275*b*. This position of the first and second fracturing port covers 215*a*, 215*b* may be similar to the run-in-hole position for the downhole fracturing tool assemblies 210*a*, 210*b*.

Figure 5B:
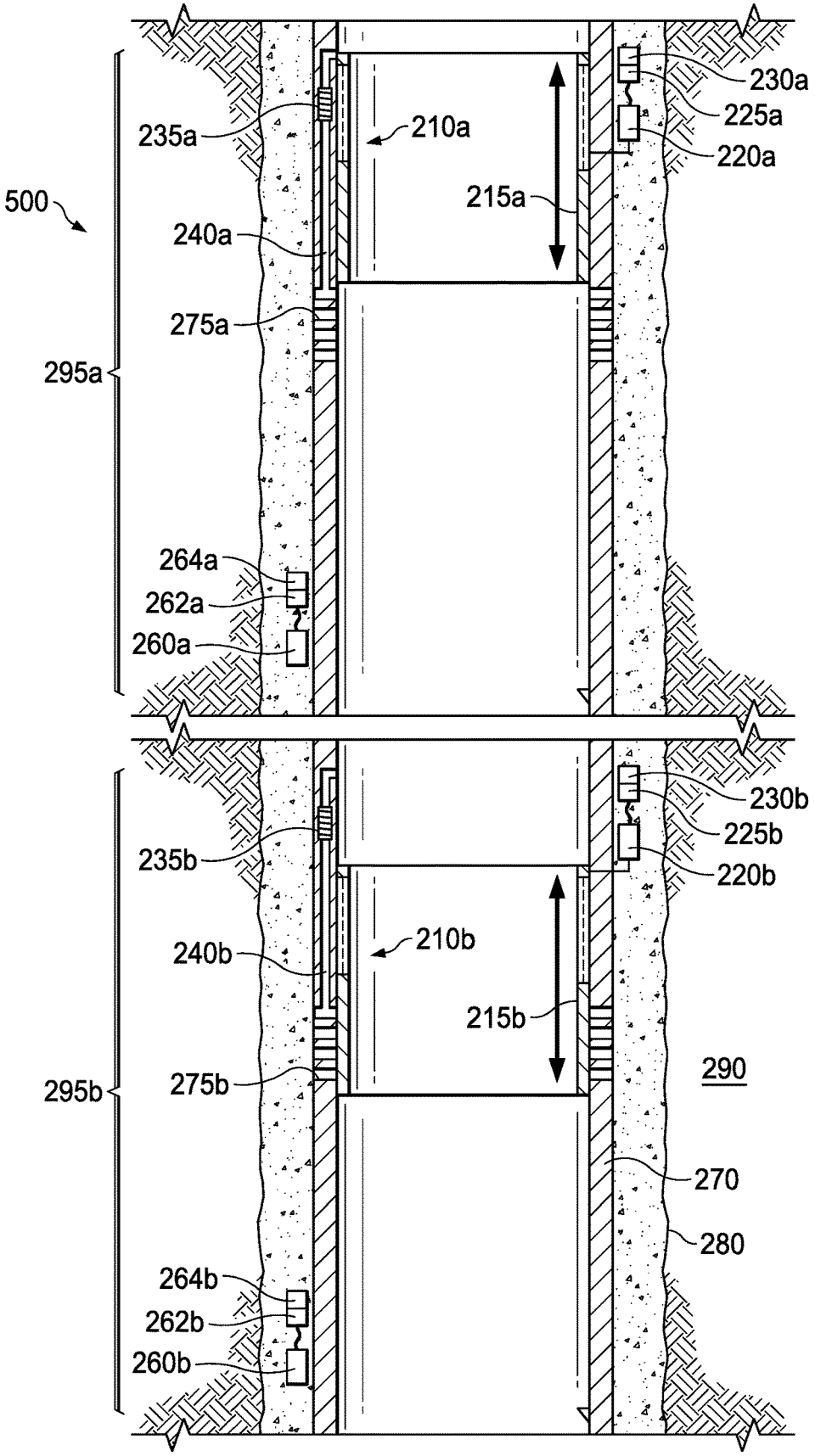

Turning to FIG. 5B, illustrated is the well system 500 of FIG. 5A after beginning the fracturing process of the first fracturing zone of interest 295*a*. As shown, the first fracturing port cover 215*a* has been moved to the second position exposing the one or more fracturing ports 275*a*, while the second fracturing port cover 215*b* remains in the first position sealing the one or more fracturing ports 275*b*. Accordingly, the first fracturing zone of interest 295*a* is isolated from the second fracturing zone of interest using the second fracturing port cover 215*b*.

Figure 5C:
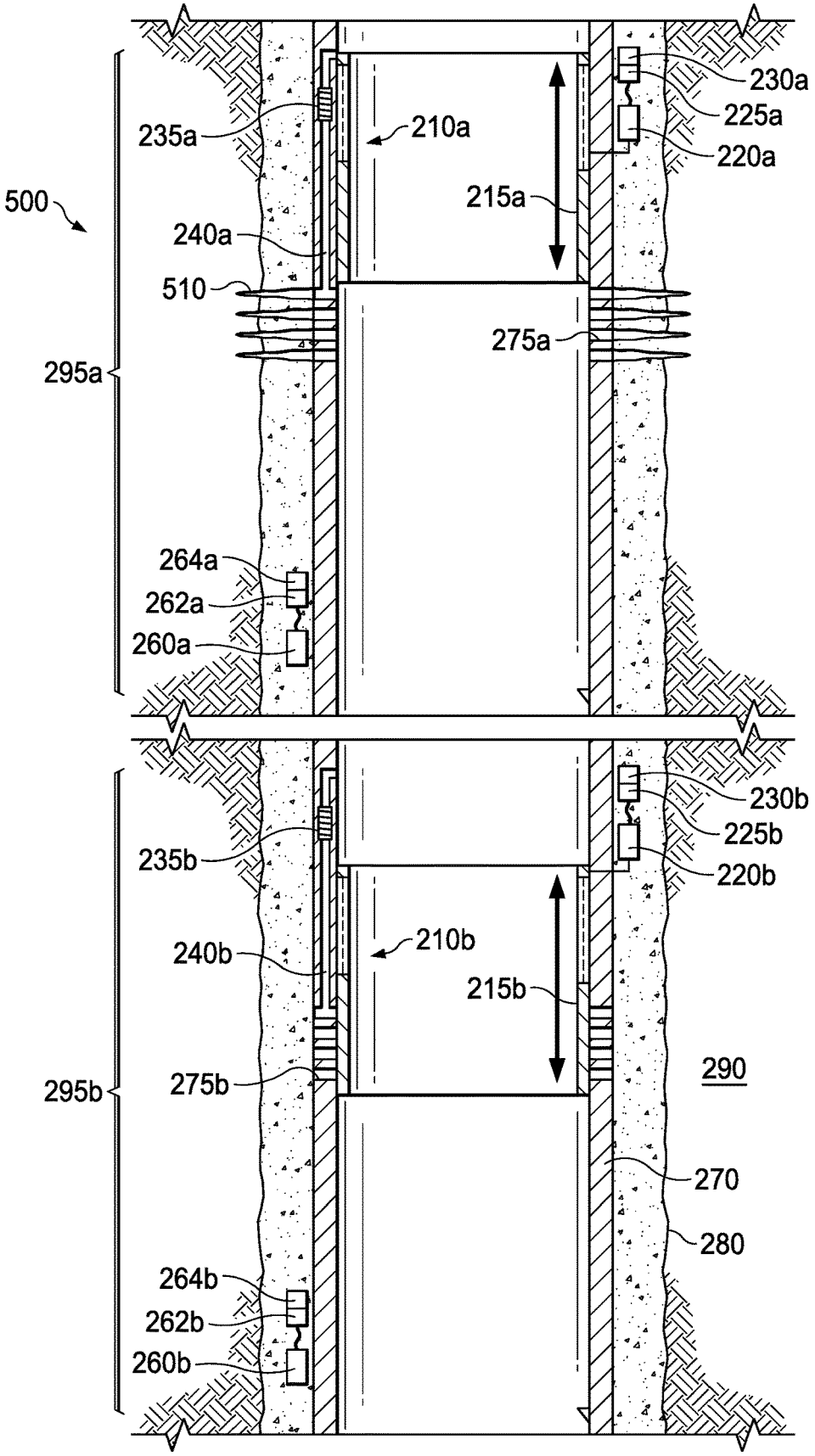

Turning to FIG. 5C, illustrated is the well system 500 of FIG. 5B after fracturing the first zone of interest 295*a*. Ultimately, the fracturing of the first zone of interest 295*a* introduces fractures 510 within the subterranean formation 290 proximate the fracturing ports 275*a*. Those skilled in the art understand the process of fracturing the first zone of interest 295*a*, including subjecting the exposed first zone of interest 295*a* to high pressure fluid, which may or may not contain proppant therein.

Figure 5D:
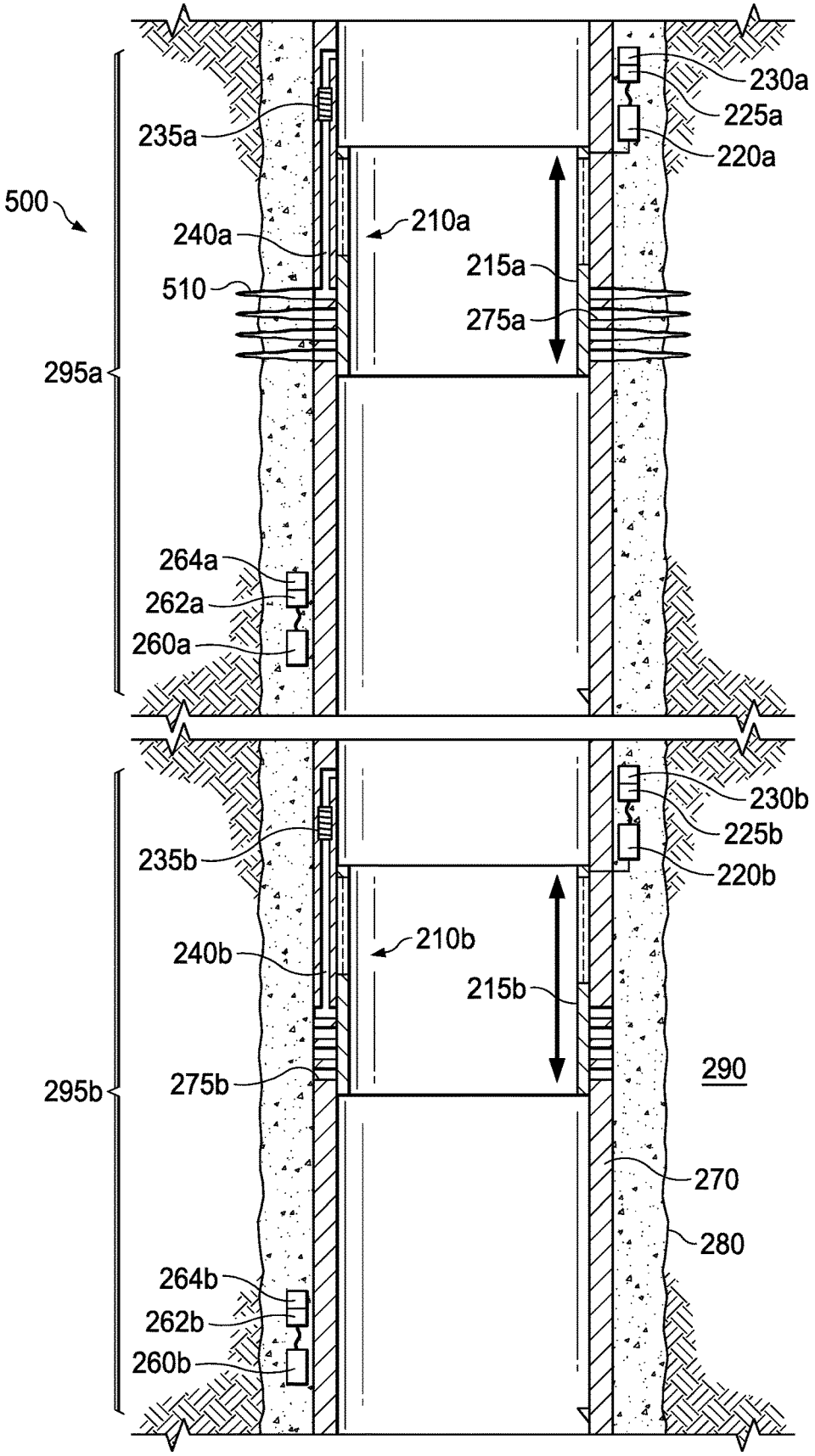

Turning to FIG. 5D, illustrated is the well system 500 of FIG. 5C after the optional step of moving the first fracturing port cover 215*a* back to the first position sealing the one or more fracturing ports 275*a*. In another embodiment, the first fracturing port cover 215*a* could be moved to the third position, such that the screen region is over the one or more fracturing ports 275*a*, thereby holding proppant within the formation 290. In yet another embodiment, the first fracturing port cover 215*a* could remain in the second position exposing the one or more fracturing ports 275*a*.

Figure 5E:
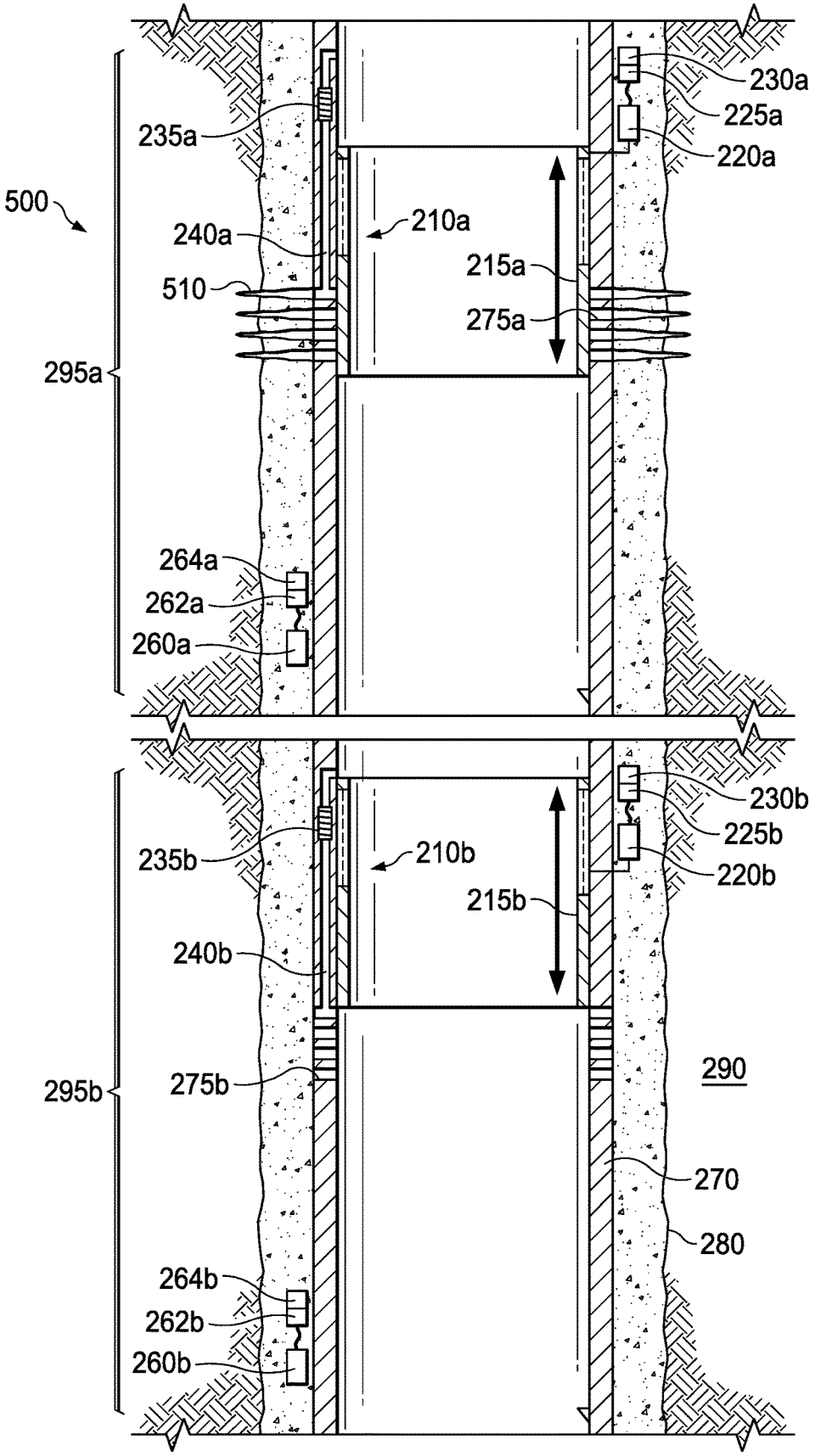

Turning to FIG. 5E, illustrated is the well system 500 of FIG. 5D after the second fracturing port cover 215*b* has been moved to the second position exposing the one or more fracturing ports 275*b*. Accordingly, the second fracturing zone of interest 295*b* is isolated from the first fracturing zone of interest 295*a* using the first fracturing port cover 215*a*.

Figure 5F:
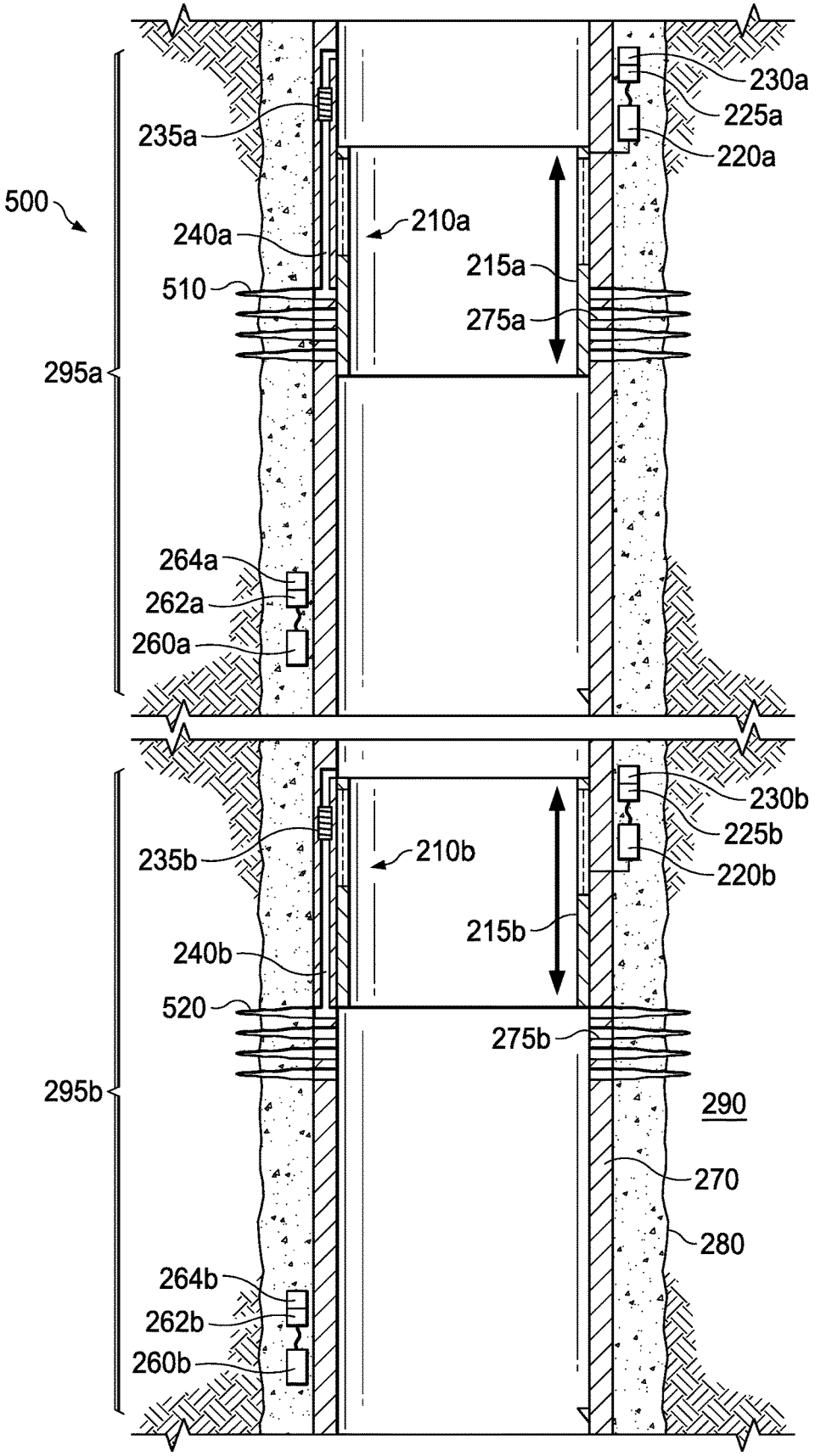

Turning to FIG. 5F, illustrated is the well system 500 of FIG. 5E after fracturing the second zone of interest 295*b*. Ultimately, the fracturing of the second zone of interest 295*b* introduces fractures 520 within the subterranean formation 290 proximate the fracturing ports 275*b*. Those skilled in the art understand the process of fracturing the second zone of interest 295*b*, including subjecting the exposed second zone of interest 295*b* to high pressure fluid, which may or may not contain proppant therein.

Figure 5G:
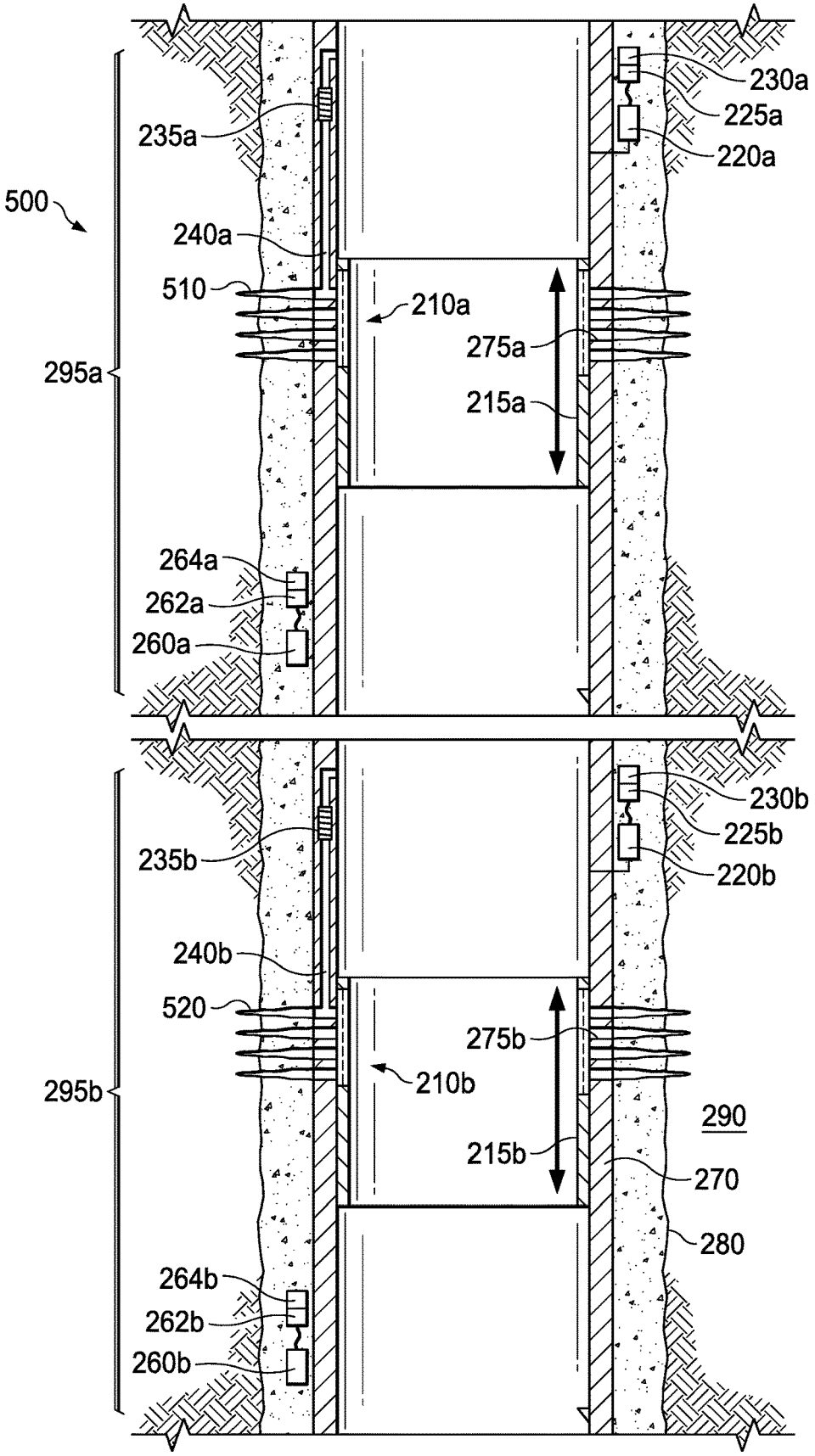

Turning to FIG. 5G, illustrated is the well system 500 of FIG. 5F after the optional step of moving the first and second port covers 215*a*, 215*b* to their respective third positions, such that the screen regions of the first and second port covers 215*a*, 215*b* are over the one or more fracturing ports 275*a*, 275*b*, respectively. Accordingly, the screen regions of the first and second port covers 215*a*, 215*b* hold the proppant within the formation 290.

Aspects disclosed herein include:

A. A downhole zonal isolation assembly, the downhole zonal isolation assembly including: 1) a rotating fracturing valve positionable within wellbore casing proximate a fracturing zone of interest, 2) a rotating fracturing valve actuator coupled to the rotating fracturing valve; and 3) rotating fracturing valve electronics coupled to the rotating fracturing valve actuator, the rotating fracturing valve electronics operable to activate the rotating fracturing valve actuator to move the rotating fracturing valve from a first wellbore casing open position to a second wellbore casing closed position.

B. A well system, the well system including: 1) a wellbore extending into one or more subterranean formations; 2) wellbore casing located within the wellbore; and 3) a first downhole zonal isolation assembly positioned within the wellbore casing proximate a first fracturing zone of interest, and a second downhole zonal isolation assembly positioned within the wellbore casing proximate a second fracturing zone of interest, each of the first and second downhole zonal isolation assemblies including; a) a rotating fracturing valve positioned within the wellbore casing, b) a rotating fracturing valve actuator coupled to the rotating fracturing valve; and c) rotating fracturing valve electronics coupled to the rotating fracturing valve actuator, the rotating fracturing valve electronics operable to activate the rotating fracturing valve actuator to move the rotating fracturing valve from the first wellbore casing open position to the second wellbore casing closed position.

C. A method for fracturing a well system, the method including: 1) positioning a first downhole zonal isolation assembly within wellbore casing and proximate a first fracturing zone of interest, and a second downhole zonal isolation assembly within the wellbore casing proximate a second fracturing zone of interest, each of the first and second downhole zonal isolation assemblies including; a) a rotating fracturing valve positioned within the wellbore casing, b) a rotating fracturing valve actuator coupled to the rotating fracturing valve; and c) rotating fracturing valve electronics coupled to the rotating fracturing valve actuator, the rotating fracturing valve electronics operable to activate the rotating fracturing valve actuator to move the rotating fracturing valve from the first wellbore casing open position to the second wellbore casing closed position; and 2) moving the rotating fracturing valve of the second downhole zonal isolation assembly from its first wellbore casing open position to the second wellbore casing closed position while the rotating fracturing valve of the first downhole zonal isolation assembly remains within its first wellbore casing open position.

Aspects A, B, and C may have one or more of the following additional elements in combination: Element 1: wherein the rotating fracturing valve is a rotating flapper valve. Element 2: wherein the rotating fracturing valve is a rotating ball valve. Element 3: wherein the rotating fracturing valve actuator is a release mechanism, and further wherein fluid within the wellbore casing is operable to move the rotating fracturing valve from the first wellbore casing open position to the second wellbore casing closed position. Element 4: wherein the rotating fracturing valve electronics are operable to activate the rotating fracturing valve actuator based upon changes in at least one of time, temperature, pressure or flow. Element 5: wherein the rotating fracturing valve electronics are operable to activate the rotating fracturing valve actuator based upon a signal encoded on the wellbore casing or within fluid within the wellbore casing. Element 6: wherein the rotating fracturing valve electronics are operable to activate the rotating fracturing valve actuator based upon a signal received from a drop ball or drop plug traversing down the wellbore casing. Element 7: wherein at least a portion of the rotating fracturing valve is dissolvable. Element 8: wherein the rotating fracturing valve is a rotating flapper valve. Element 9: wherein the rotating fracturing valve is a rotating ball valve. Element 10: wherein the rotating fracturing valve actuator is a release mechanism, and further wherein fluid within the wellbore casing is operable to move the rotating fracturing valve from the first wellbore casing open position to the second wellbore casing closed position. Element 11: wherein the rotating fracturing valve electronics are operable to activate the rotating fracturing valve actuator based upon changes in at least one of time, temperature, pressure or flow. Element 12: wherein the rotating fracturing valve electronics are operable to activate the rotating fracturing valve actuator based upon a signal encoded on the wellbore casing or within fluid within the wellbore casing. Element 13: wherein the rotating fracturing valve electronics are operable to activate the rotating fracturing valve actuator based upon a signal received from a drop ball or drop plug traversing down the wellbore casing. Element 14: wherein at least a portion of the rotating fracturing valve is dissolvable. Element 15: further including a first downhole fracturing tool assembly positioned uphole of the first downhole zonal isolation assembly and proximate the first fracturing zone of interest, and a second downhole fracturing tool assembly positioned between the first and second zonal isolation assemblies and proximate the second fracturing zone of interest, wherein each of the first and second downhole fracturing tool assemblies include: a fracturing port cover coupleable to an interior of a wellbore casing having one or more fracturing ports therein; a fracturing port cover actuator coupled to the fracturing port cover, the fracturing port cover actuator operable to move the fracturing port cover between a first position sealing the one or more fracturing ports from an interior of the wellbore casing and a second position fully exposing the one or more fracturing ports to the interior of the wellbore casing; and fracturing port cover electronics coupled to the fracturing port cover actuator proximate the fracturing port cover, the fracturing port cover electronics operable to activate the fracturing port cover actuator. Element 16: wherein the second downhole zonal isolation assembly is located downhole of the first downhole zonal isolation assembly, and further including a first downhole fracturing tool assembly positioned uphole of the first downhole zonal isolation assembly and proximate the first fracturing zone of interest, and a second downhole fracturing tool assembly positioned between the first and second zonal isolation assemblies and proximate the second fracturing zone of interest, wherein each of the first and second downhole fracturing tool assemblies include: a fracturing port cover coupleable to an interior of a wellbore casing having one or more fracturing ports therein; a fracturing port cover actuator coupled to the fracturing port cover, the fracturing port cover actuator operable to move the fracturing port cover between a first position sealing the one or more fracturing ports from an interior of the wellbore casing and a second position fully exposing the one or more fracturing ports to the interior of the wellbore casing; and fracturing port cover electronics coupled to the fracturing port cover actuator proximate the fracturing port cover, the fracturing port cover electronics operable to activate the fracturing port cover actuator. Element 17: further including moving the fracturing port cover of the first downhole fracturing tool assembly to its first position sealing its one or more fracturing ports, moving the fracturing port cover of the second downhole fracturing tool assembly to its second position fully exposing its one or more fracturing ports, and then fracturing the second fracturing zone of interest after moving the rotating fracturing valve of the second downhole zonal isolation assembly from its first wellbore casing open position to the second wellbore casing closed position.

Those skilled in the art to which this application relates will appreciate that other and further additions, deletions, substitutions and modifications may be made to the described embodiments.

What is claimed is:

1. A downhole zonal isolation assembly, comprising:

a rotating fracturing valve positionable within wellbore casing proximate a fracturing zone of interest;

a rotating fracturing valve actuator coupled to the rotating fracturing valve; and rotating fracturing valve electronics coupled to the rotating fracturing valve actuator, the rotating fracturing valve electronics operable to activate the rotating fracturing valve actuator to move the rotating fracturing valve from a first wellbore casing open position to a second wellbore casing closed position, wherein the rotating fracturing valve is configured to move between the first wellbore casing open position and the second wellbore casing closed positioned independent of a movement of a fracturing port cover that it is configured to operate in conjunction with.

2. The downhole zonal isolation assembly as recited in claim 1, wherein the rotating fracturing valve is a rotating flapper valve.

3. The downhole zonal isolation assembly as recited in claim 1, wherein the rotating fracturing valve is a rotating ball valve.

4. The downhole zonal isolation assembly as recited in claim 1, wherein the rotating fracturing valve actuator is a release mechanism, and further wherein fluid within the wellbore casing is operable to move the rotating fracturing valve from the first wellbore casing open position to the second wellbore casing closed position.

5. The downhole zonal isolation assembly as recited in claim 1, wherein the rotating fracturing valve electronics are operable to activate the rotating fracturing valve actuator based upon changes in at least one of time, temperature, pressure or flow.

6. The downhole zonal isolation assembly as recited in claim 1, wherein the rotating fracturing valve electronics are operable to activate the rotating fracturing valve actuator based upon a signal encoded on the wellbore casing or within fluid within the wellbore casing.

7. The downhole zonal isolation assembly as recited in claim 1, wherein the rotating fracturing valve electronics are operable to activate the rotating fracturing valve actuator based upon a signal received from a drop ball or drop plug traversing down the wellbore casing.

8. The downhole zonal isolation assembly as recited in claim 1, wherein at least a portion of the rotating fracturing valve is dissolvable.

9. The downhole zonal isolation assembly as recited in claim 1, wherein the rotating fracturing valve may only rotate from the first wellbore casing open position to the second wellbore casing closed position and not from the second wellbore casing closed position to the first wellbore casing open position.

10. A well system, comprising:

a wellbore extending into one or more subterranean formations;

wellbore casing located within the wellbore; and a first downhole zonal isolation assembly positioned within the wellbore casing proximate a first fracturing zone of interest, and a second downhole zonal isolation assembly positioned within the wellbore casing proximate a second fracturing zone of interest, each of the first and second downhole zonal isolation assemblies including;

a rotating fracturing valve positioned within the wellbore casing, a rotating fracturing valve actuator coupled to the rotating fracturing valve; and rotating fracturing valve electronics coupled to the rotating fracturing valve actuator, the rotating fracturing valve electronics operable to activate the rotating fracturing valve actuator to move the rotating fracturing valve from the first wellbore casing open position to the second wellbore casing closed position, wherein the rotating fracturing valve is configured to move between the first wellbore casing open position and the second wellbore casing closed positioned independent of a movement of a fracturing port cover that it is configured to operate in conjunction with.

11. The well system as recited in claim 10, wherein the rotating fracturing valve is a rotating flapper valve.

12. The well system as recited in claim 10, wherein the rotating fracturing valve is a rotating ball valve.

13. The well system as recited in claim 10, wherein the rotating fracturing valve actuator is a release mechanism, and further wherein fluid within the wellbore casing is operable to move the rotating fracturing valve from the first wellbore casing open position to the second wellbore casing closed position.

14. The well system as recited in claim 10, wherein the rotating fracturing valve electronics are operable to activate the rotating fracturing valve actuator based upon changes in at least one of time, temperature, pressure or flow.

15. The well system as recited in claim 10, wherein the rotating fracturing valve electronics are operable to activate the rotating fracturing valve actuator based upon a signal encoded on the wellbore casing or within fluid within the wellbore casing.

16. The well system as recited in claim 10, wherein the rotating fracturing valve electronics are operable to activate the rotating fracturing valve actuator based upon a signal received from a drop ball or drop plug traversing down the wellbore casing.

17. The well system as recited in claim 10, wherein at least a portion of the rotating fracturing valve is dissolvable.

18. The well system as recited in claim 10, further including a first downhole fracturing tool assembly positioned uphole of the first downhole zonal isolation assembly and proximate the first fracturing zone of interest, and a second downhole fracturing tool assembly positioned between the first and second zonal isolation assemblies and proximate the second fracturing zone of interest, wherein each of the first and second downhole fracturing tool assemblies include:

the fracturing port cover coupleable to an interior of a wellbore casing having one or more fracturing ports therein;

a fracturing port cover actuator coupled to the fracturing port cover, the fracturing port cover actuator operable to move the fracturing port cover between a first position sealing the one or more fracturing ports from an interior of the wellbore casing and a second position fully exposing the one or more fracturing ports to the interior of the wellbore casing; and fracturing port cover electronics coupled to the fracturing port cover actuator proximate the fracturing port cover, the fracturing port cover electronics operable to activate the fracturing port cover actuator.

19. The well system as recited in claim 10, wherein the rotating fracturing valve may only rotate from the first wellbore casing open position to the second wellbore casing closed position and not from the second wellbore casing closed position to the first wellbore casing open position.

20. A method for fracturing a well system, comprising:

positioning a first downhole zonal isolation assembly within wellbore casing and proximate a first fracturing zone of interest, and a second downhole zonal isolation assembly within the wellbore casing proximate a second fracturing zone of interest, each of the first and second downhole zonal isolation assemblies including;

a rotating fracturing valve positioned within the wellbore casing;

a rotating fracturing valve actuator coupled to the rotating fracturing valve; and rotating fracturing valve electronics coupled to the rotating fracturing valve actuator, the rotating fracturing valve electronics operable to activate the rotating fracturing valve actuator to move the rotating fracturing valve from the first wellbore casing open position to the second wellbore casing closed position; and moving the rotating fracturing valve of the second downhole zonal isolation assembly from its first wellbore casing open position to the second wellbore casing closed position while the rotating fracturing valve of the first downhole zonal isolation assembly remains within its first wellbore casing open position, wherein the rotating fracturing valve is configured to move between the first wellbore casing open position and the second wellbore casing closed positioned independent of a movement of a fracturing port cover that it is configured to operate in conjunction with.

21. The method as recited in claim 20, wherein the second downhole zonal isolation assembly is located downhole of the first downhole zonal isolation assembly, and further including a first downhole fracturing tool assembly positioned uphole of the first downhole zonal isolation assembly and proximate the first fracturing zone of interest, and a second downhole fracturing tool assembly positioned between the first and second zonal isolation assemblies and proximate the second fracturing zone of interest, wherein each of the first and second downhole fracturing tool assemblies include:

the fracturing port cover coupleable to an interior of a wellbore casing having one or more fracturing ports therein;

a fracturing port cover actuator coupled to the fracturing port cover, the fracturing port cover actuator operable to move the fracturing port cover between a first position sealing the one or more fracturing ports from an interior of the wellbore casing and a second position fully exposing the one or more fracturing ports to the interior of the wellbore casing; and fracturing port cover electronics coupled to the fracturing port cover actuator proximate the fracturing port cover, the fracturing port cover electronics operable to activate the fracturing port cover actuator.

22. The method as recited in claim 21, further including moving the fracturing port cover of the first downhole fracturing tool assembly to its first position sealing its one or more fracturing ports, moving the fracturing port cover of the second downhole fracturing tool assembly to its second position fully exposing its one or more fracturing ports, and then fracturing the second fracturing zone of interest after moving the rotating fracturing valve of the second downhole zonal isolation assembly from its first wellbore casing open position to the second wellbore casing closed position.

23. The method as recited in claim 20, wherein the rotating fracturing valve may only rotate from the first wellbore casing open position to the second wellbore casing closed position and not from the second wellbore casing closed position to the first wellbore casing open position.

* * * * *